US008292547B2

(12) United States Patent
Johanneck et al.

(10) Patent No.: US 8,292,547 B2
(45) Date of Patent: Oct. 23, 2012

(54) FLOATING DOCK, CONNECTION SYSTEM, AND ACCESSORIES

(75) Inventors: Richard G. Johanneck, Buffalo, MN (US); Paul A. Pilosi, Minnetonka, MN (US)

(73) Assignee: Wave Armor, L.L.C., Maple Lake, MN (US)

( * ) Notice: Subject to any disclaimer, the term of this patent is extended or adjusted under 35 U.S.C. 154(b) by 0 days.

(21) Appl. No.: 12/767,445

(22) Filed: Apr. 26, 2010

(65) Prior Publication Data

US 2011/0044765 A1 Feb. 24, 2011

Related U.S. Application Data

(60) Provisional application No. 61/172,493, filed on Apr. 24, 2009.

(51) Int. Cl.
*B63B 35/44* (2006.01)

(52) U.S. Cl. ..... 405/219; 114/263; 114/266

(58) Field of Classification Search ..... 405/218, 405/219, 220, 221; 114/264, 266, 258, 263
See application file for complete search history.

(56) References Cited

U.S. PATENT DOCUMENTS 3,152,568 A * 10/1964 Mayer ..... 114/266
3,656,639 A 4/1972 Lothen
3,773,195 A 11/1973 Honea
3,856,717 A 12/1974 Theard et al.
3,873,407 A 3/1975 Kumata et al.
4,078,515 A * 3/1978 Svirklys ..... 405/219
4,092,755 A 6/1978 Hughes
4,268,211 A 5/1981 Schwebke
4,464,092 A 8/1984 Chambers et al.
4,505,619 A 3/1985 Sargent
4,641,596 A 2/1987 Reprogle et al.
4,714,375 A 12/1987 Stevenson et al.
4,808,028 A 2/1989 White
5,015,667 A 5/1991 Yoshimura et al.
5,090,842 A 2/1992 Montgomery
5,158,032 A 10/1992 Pitt
5,281,055 A 1/1994 Neitzke et al.
5,429,063 A 7/1995 Rosenkranz
5,503,921 A 4/1996 Chang et al.
5,576,080 A 11/1996 Sugimoto et al.
D389,923 S 1/1998 Hillman et al.
D398,576 S 9/1998 Hillman et al.
5,845,594 A * 12/1998 Hallsten et al. ..... 114/263
5,915,325 A * 6/1999 Gerber et al. ..... 114/263
5,941,660 A 8/1999 Rueckert
6,006,687 A 12/1999 Hillman et al.

(Continued)

OTHER PUBLICATIONS

Archer, E. et al., "The Rotational Molding Characteristics of Metallocene Polyethylene Skin/Foam Structures," *Journal of Cellular Plastics*, 2007; 43; 491-504 Nov. 2007, 15 pages.

(Continued)

*Primary Examiner* — Frederick L Lagman
(74) *Attorney, Agent, or Firm* — Pauly, Devries Smith & Deffner, L.L.C.

(57) ABSTRACT

The present invention is directed to a floating dock system, the floating dock system comprising at least two dock sections, said dock sections said dock sections comprising substantially horizontal slots along at least one edge; and at least one coupling member configured to engage a horizontal slot in at least two dock sections; whereby the at least two dock sections are retained together by the at least one coupling member.

9 Claims, 45 Drawing Sheets

U.S. PATENT DOCUMENTS

| | | | | |
|---|---|---|---|---|
| 6,076,478 | A | 6/2000 | Siegmann | |
| 6,112,690 | A | 9/2000 | Anderson | |
| 6,179,525 | B1 * | 1/2001 | Gruhn et al. | 405/219 |
| 6,227,136 | B1 | 5/2001 | Shapiro | |
| 6,257,159 | B1 | 7/2001 | Siegmann | |
| 6,374,763 | B1 * | 4/2002 | Hartman | 114/263 |
| 6,526,902 | B1 | 3/2003 | Faber | |
| 6,602,022 | B1 | 8/2003 | Wilkins | |
| 6,912,966 | B2 | 7/2005 | Ostreng et al. | |
| D521,441 | S | 5/2006 | Ostreng et al. | |
| D521,442 | S | 5/2006 | Ostreng et al. | |
| 7,069,872 | B2 | 7/2006 | Ostreng et al. | |
| D532,360 | S | 11/2006 | Ostreng et al. | |
| 7,243,608 | B2 | 7/2007 | Knight, Jr. et al. | |
| D551,611 | S | 9/2007 | Imel | |
| 7,293,522 | B1 | 11/2007 | Elson | |
| D559,165 | S | 1/2008 | Jackson | |
| 2003/0137124 | A1 | 7/2003 | Marchese | |
| 2006/0272566 | A1 * | 12/2006 | Rueckert | 114/263 |
| 2008/0128937 | A1 | 6/2008 | Wang | |
| 2008/0264321 | A1 | 10/2008 | Jackson | |
| 2008/0282958 | A1 | 11/2008 | Jackson | |
| 2009/0010742 | A1 | 1/2009 | Stolzer | |
| 2009/0044739 | A1 | 2/2009 | Imel et al. | |
| 2009/0044740 | A1 | 2/2009 | Imel et al. | |
| 2009/0110487 | A1 * | 4/2009 | Hawkins et al. | 405/220 |

OTHER PUBLICATIONS

EZ Dock Catalog, "The First Dock of Its Kind.® The Last Dock You Will Ever Need.®" 2008, 32 pages.

* cited by examiner

FLOATING DOCK, CONNECTION SYSTEM, AND ACCESSORIES

This application claims the benefit of U.S. Provisional Application No. 61/172,493, filed Apr. 24, 2009, the content of which is herein incorporated by reference in its entirety.

FIELD OF THE INVENTION

The present invention is directed to floating docks, systems and methods for connecting sections of floating docks together, and accessories for floating docks.

BACKGROUND OF THE INVENTION

Floating docks have been in use for many years. Typical floating docks include one or more segments that are joined together by pins or other connection methods. However, existing systems have suffered from numerous shortcomings, including difficulty in assembly, poor cosmetic appearance due to exposed hardware, and lower than desired stability. Therefore, a need exists for an improved floating dock design.

SUMMARY OF THE INVENTION

The current technology is a floating dock system that incorporates multiple and variable components to arrange on an individual basis. Dock sections define slots along edges and are coupled through coupling components that mutually engage slots of two dock sections. Various accessories can be incorporated in the dock systems and are likewise coupled to dock sections, ports, and the like through similar coupling approaches.

The above summary of the present invention is not intended to describe each discussed embodiment of the present invention. This is the purpose of the figures and the detailed description that follows.

FIGURES

The invention may be more completely understood in connection with the following drawings, in which.

Figure 10A:
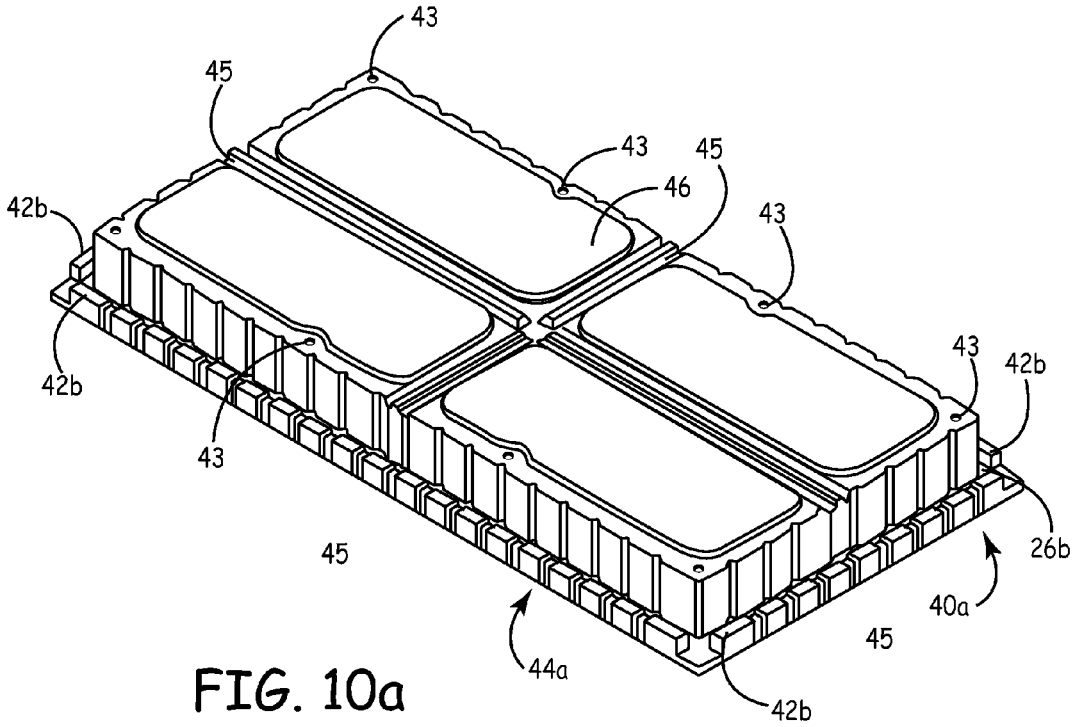

FIG. 10*a* shows a top perspective view of a bottom float panel of a dock made in accordance with an implementation of the technology disclosed herein.

Figure 10B:
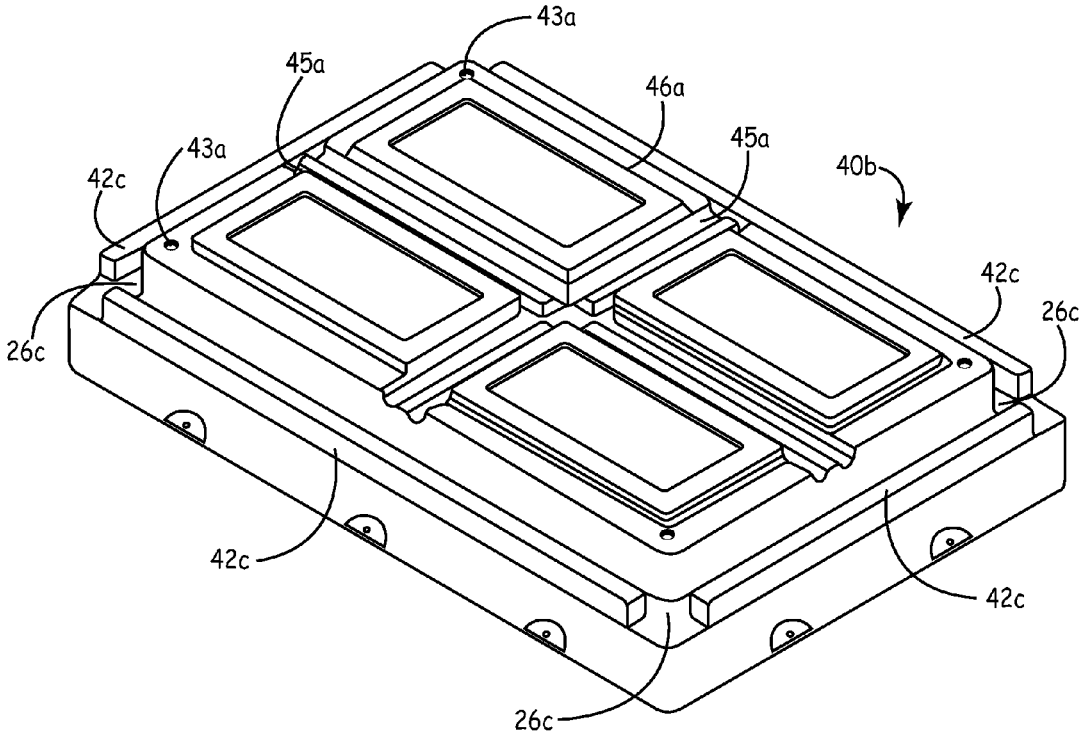

FIG. 10*b* shows a top perspective view of a bottom float panel of a dock made in accordance with an implementation of the technology disclosed herein.

Figure 11A:
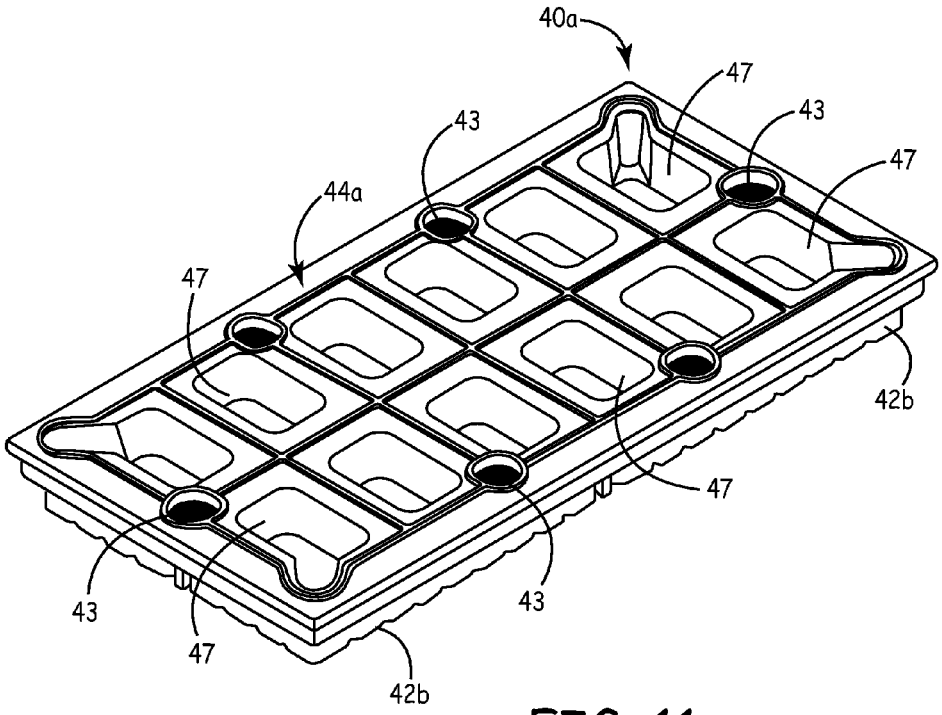

FIG. 11*a* shows a bottom perspective view of a bottom float panel of a dock made in accordance with an implementation of the technology disclosed herein.

Figure 11B:
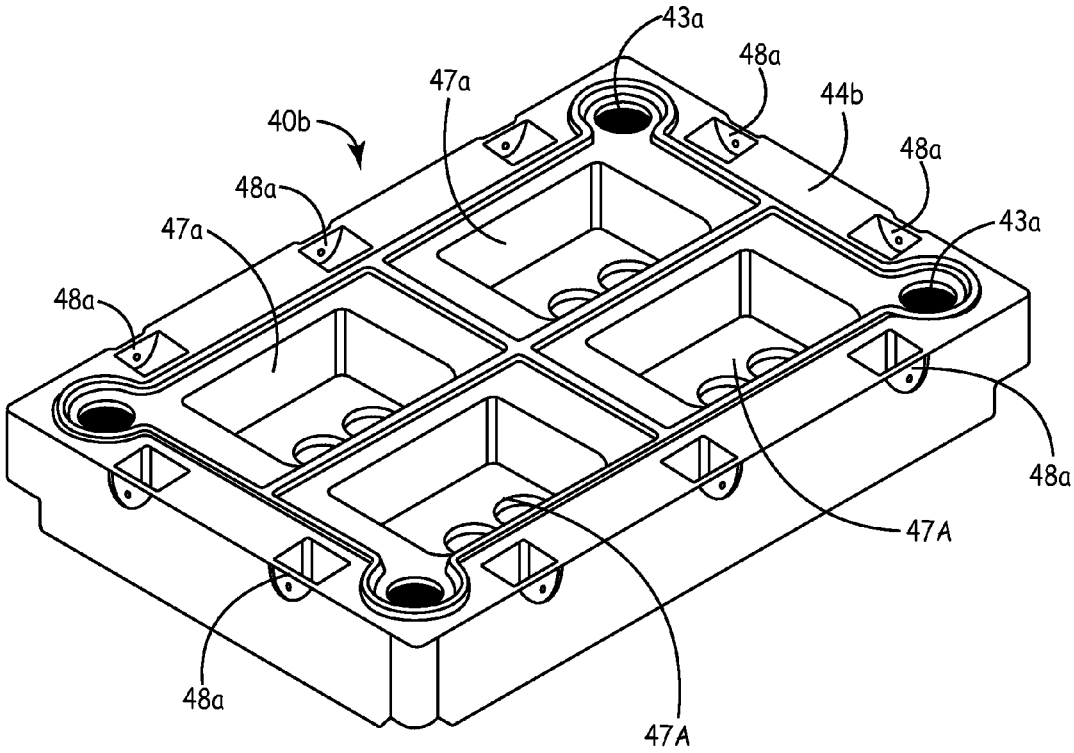

FIG. 11*b* shows a bottom perspective view of a bottom float panel of a dock made in accordance with an implementation of the technology disclosed herein.

Figure 12:
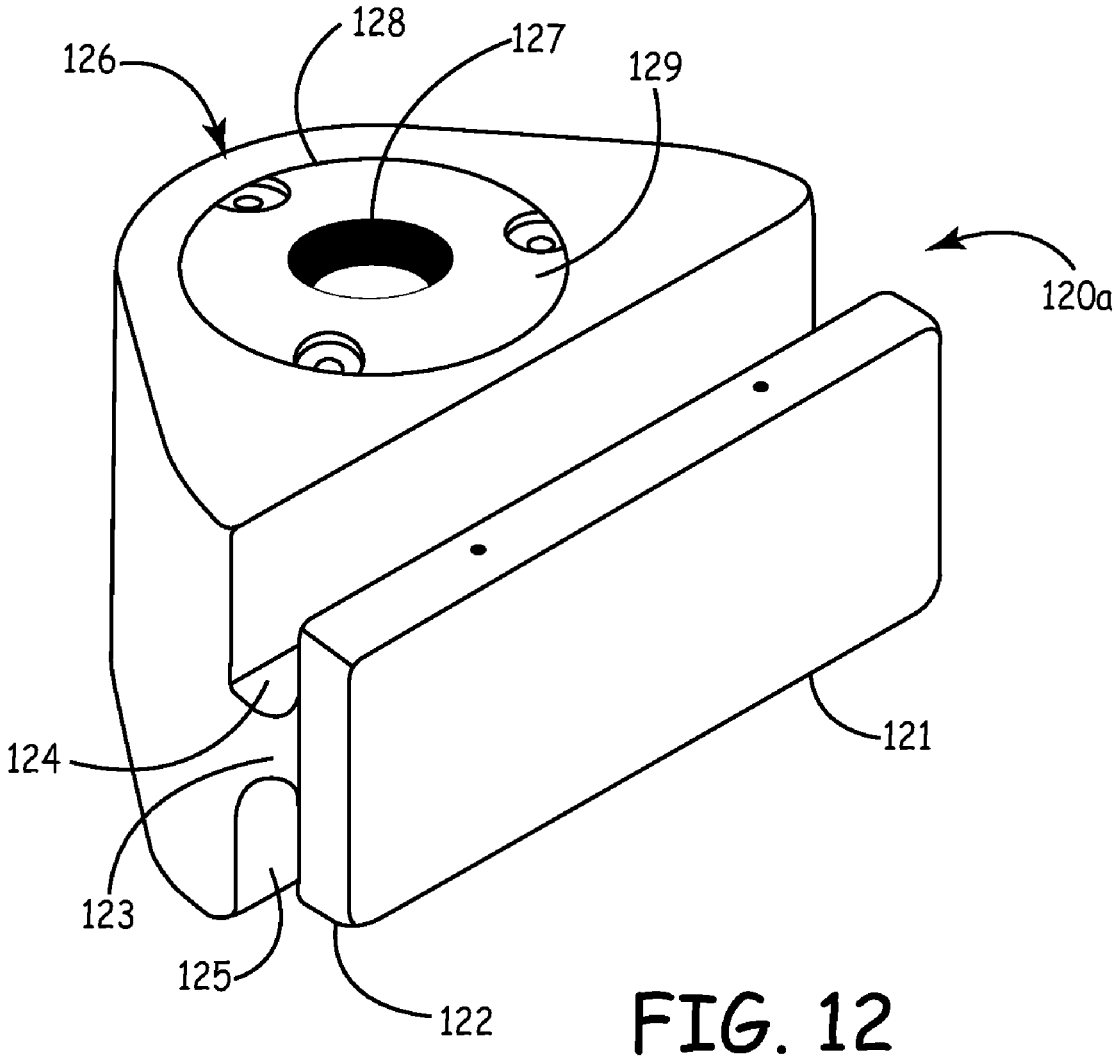

FIG. 12 depicts a post adapter made in accordance with an implementation of the technology disclosed herein.

Figures 13, 14:
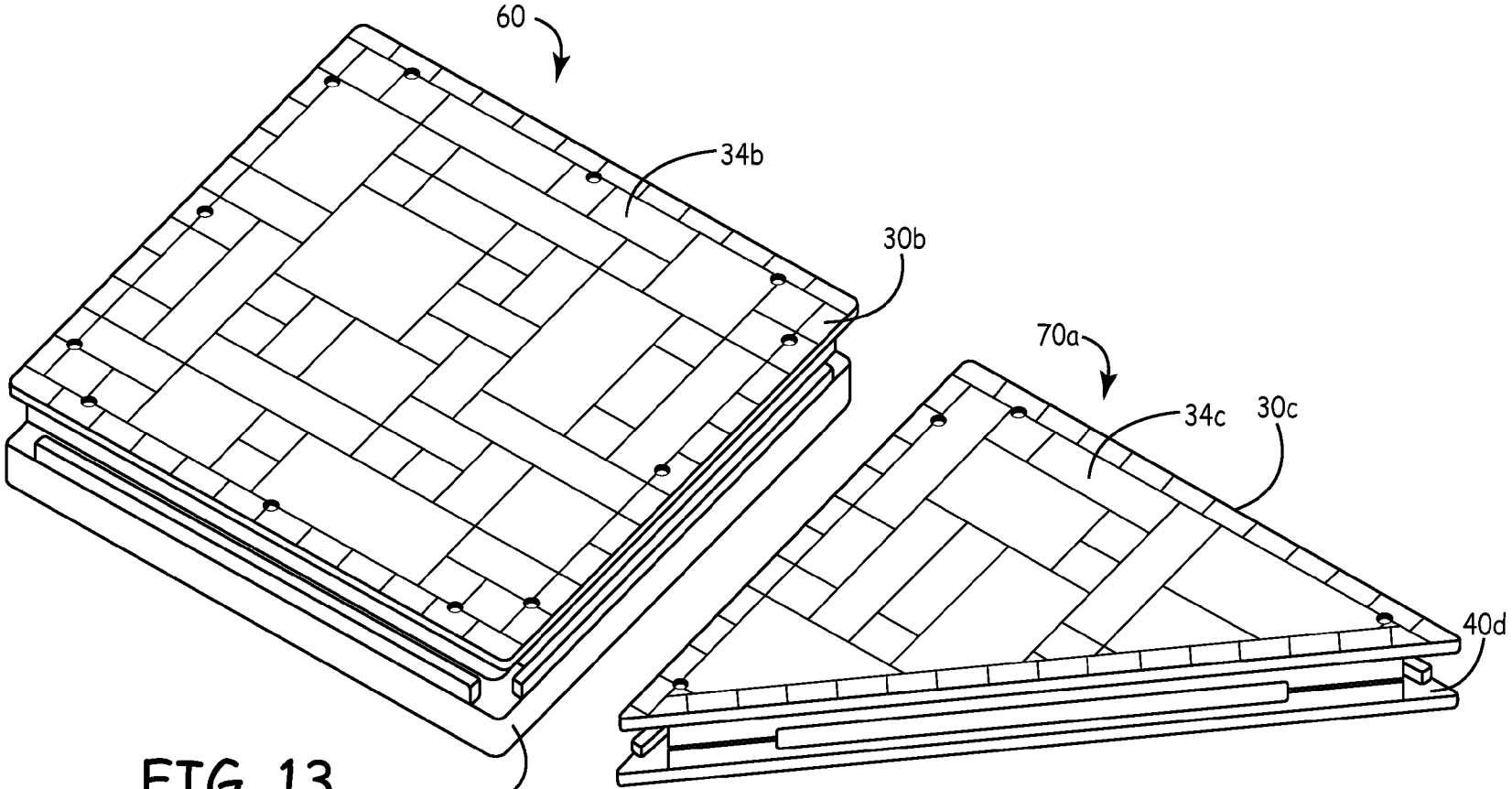

FIG. 13 shows an assembled complete square dock section made in accordance with an implementation of the technology disclosed herein.

FIG. 14 shows an assembled complete triangular dock section made in accordance with an implementation of the technology disclosed herein.

Figure 15:
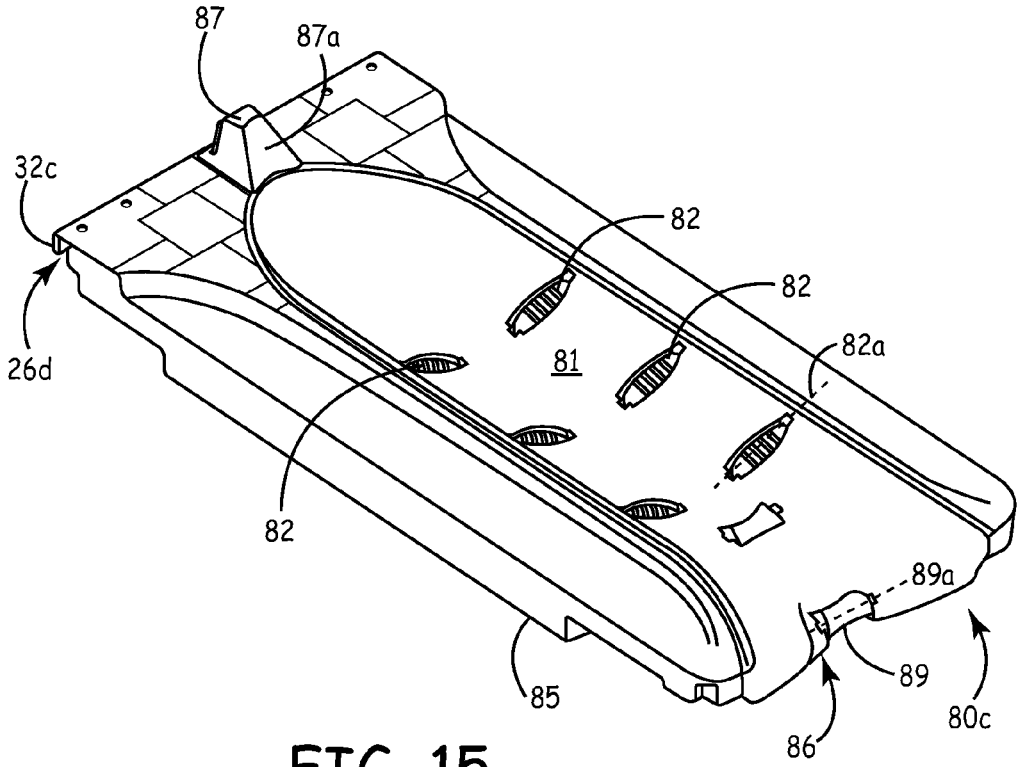

FIG. 15 shows an embodiment of a port made in accordance with an implementation of the technology disclosed herein.

Figure 16:
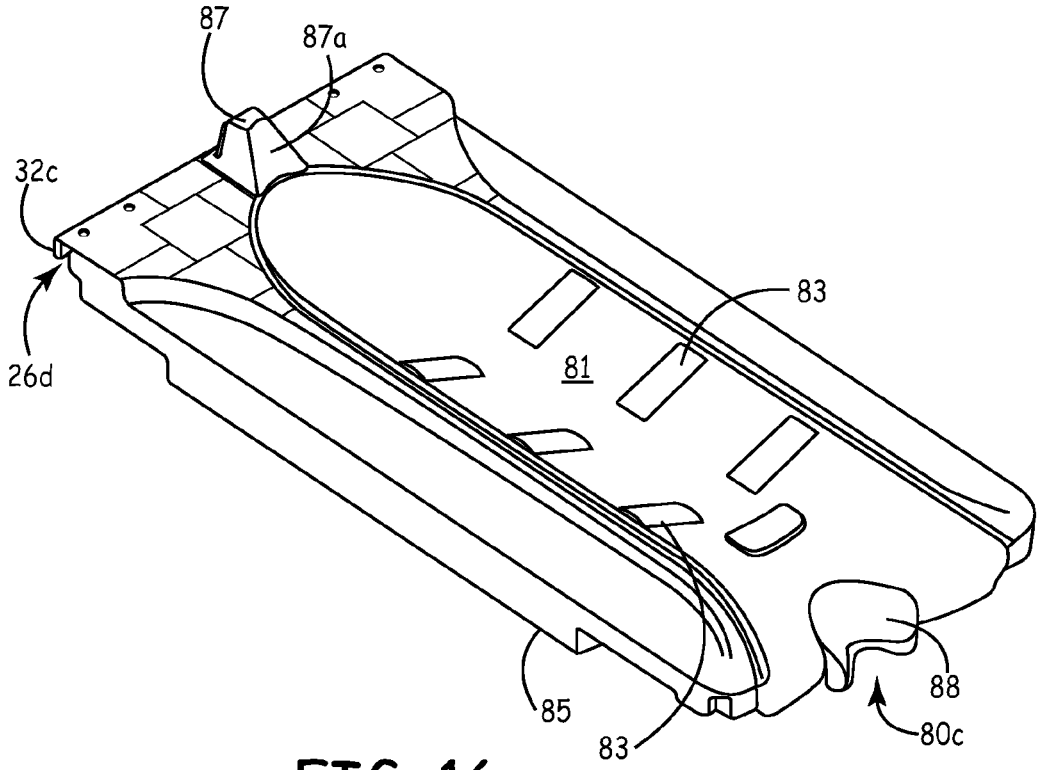

FIG. 16 shows another embodiment of a port made in accordance with an implementation of the technology disclosed herein.

Figure 17:
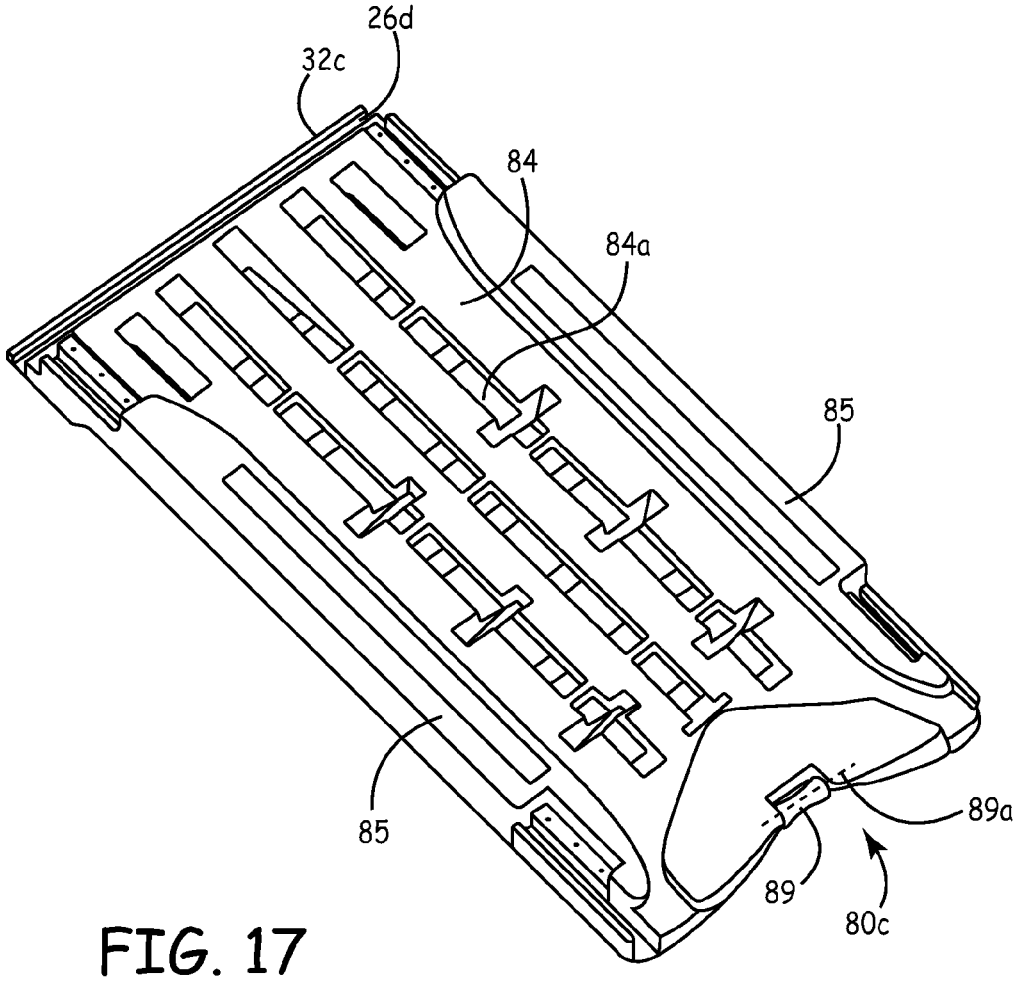

FIG. 17 shows the underside of a port made in accordance with an implementation of the technology disclosed herein.

Figure 18:
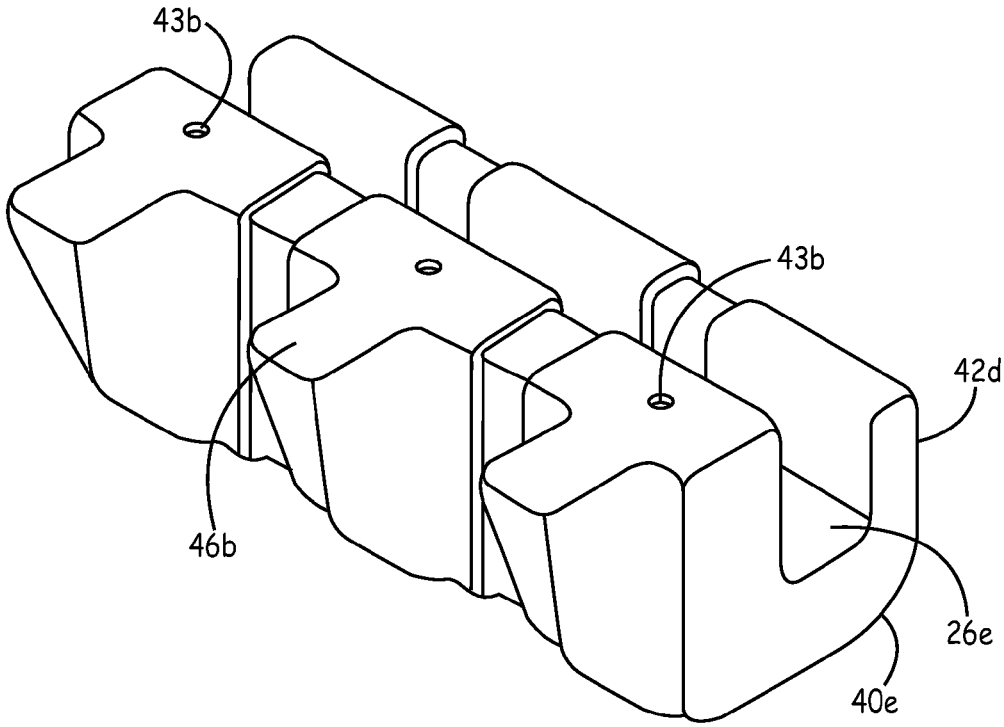

FIG. 18 depicts a c-clamp in accordance with an implementation of the technology disclosed herein.

Figure 19:
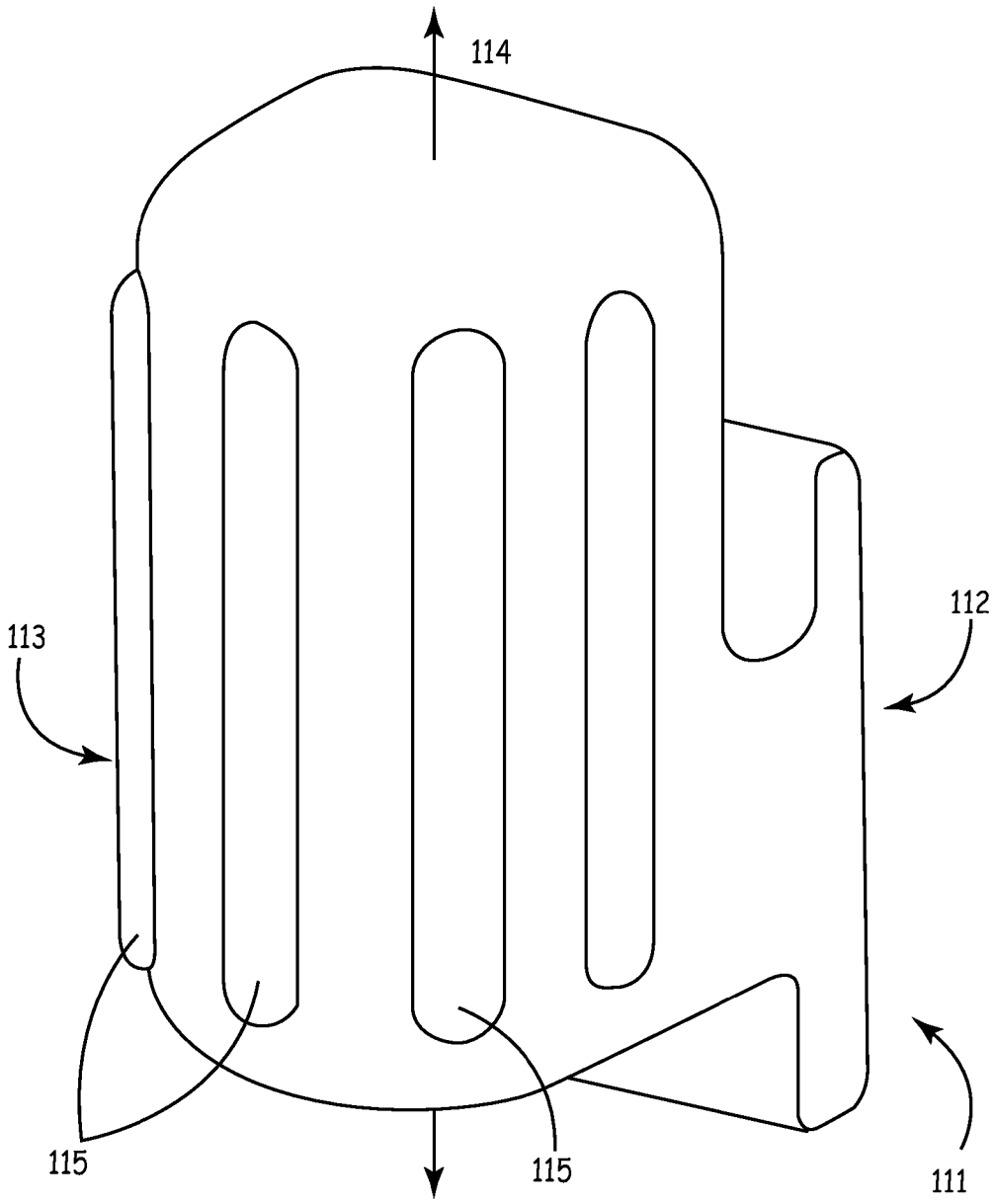

FIG. 19 shows a vertical bumper in accordance with an implementation of the technology disclosed herein.

Figure 20A:
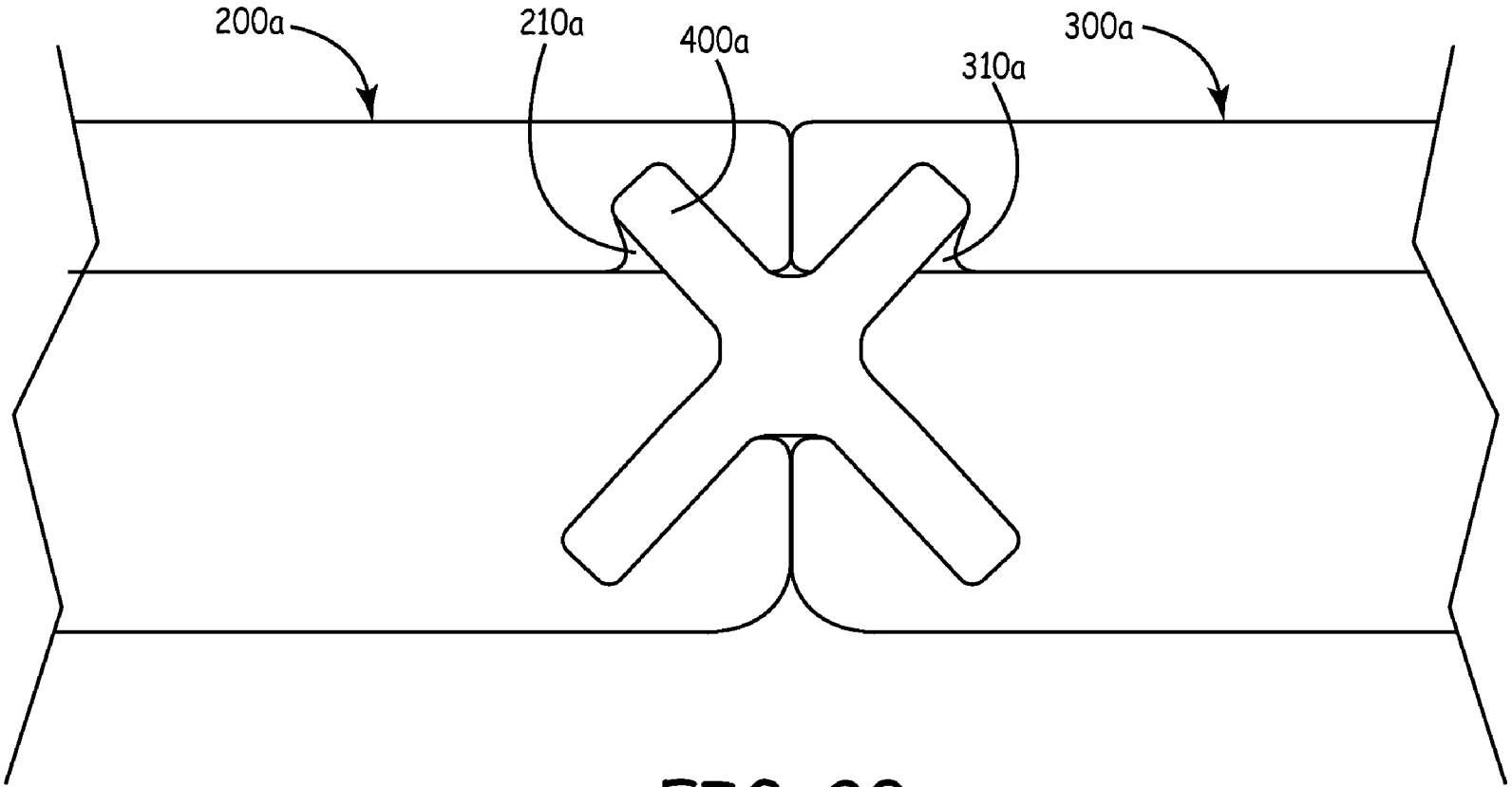

FIG. 20A shows an alternative embodiment of a connector beam in accordance with an implementation of the technology disclosed herein.

Figure 20B:
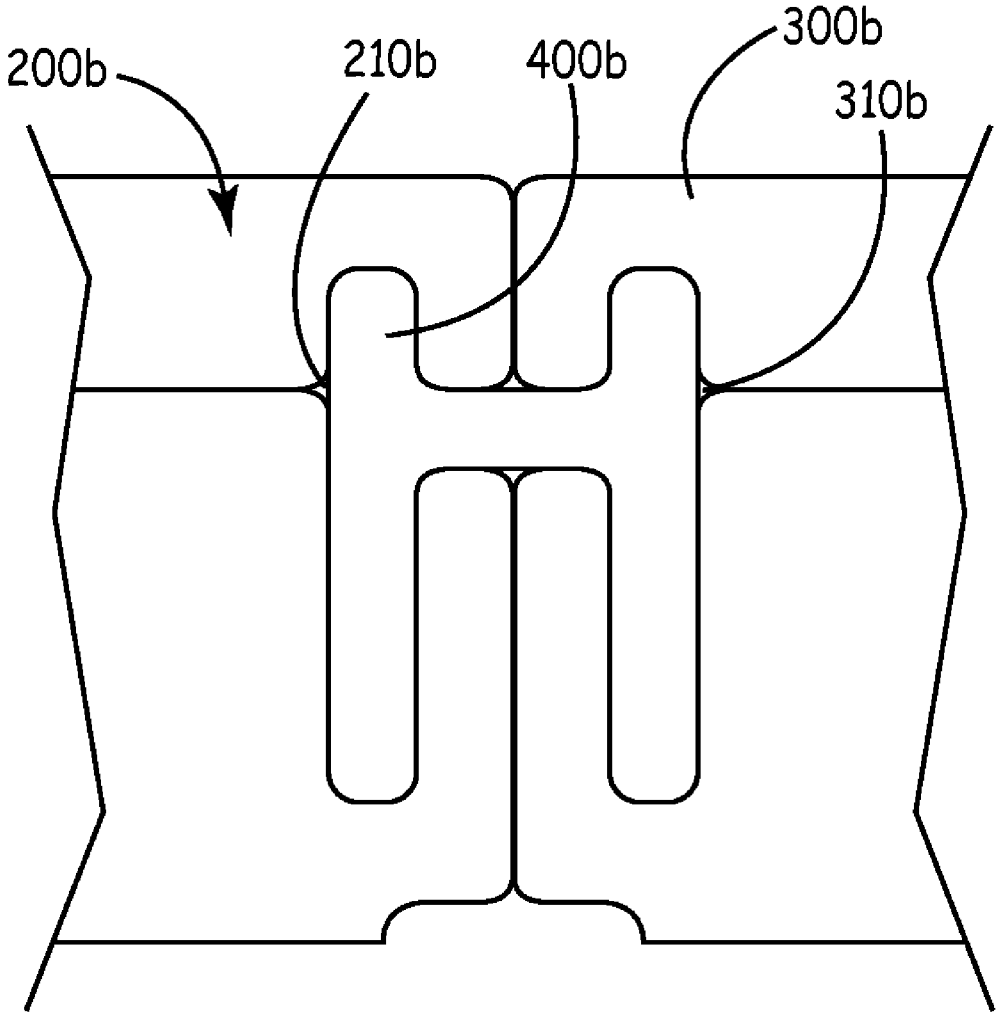

FIG. 20B shows another alternative embodiment of a connector beam in accordance with an implementation of the technology disclosed herein.

Figure 20C:
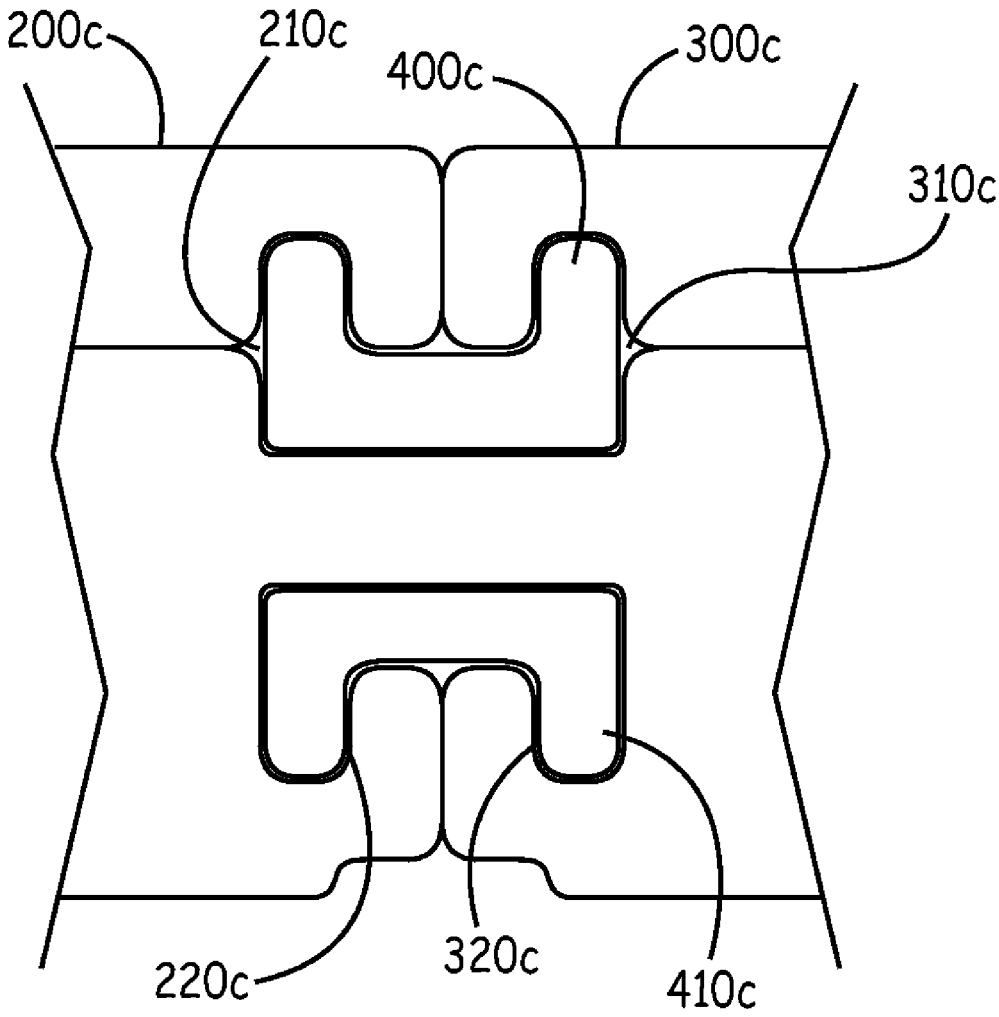

FIG. 20C shows another alternative embodiment of a connector beam in accordance with an implementation of the technology disclosed herein.

Figure 20D:
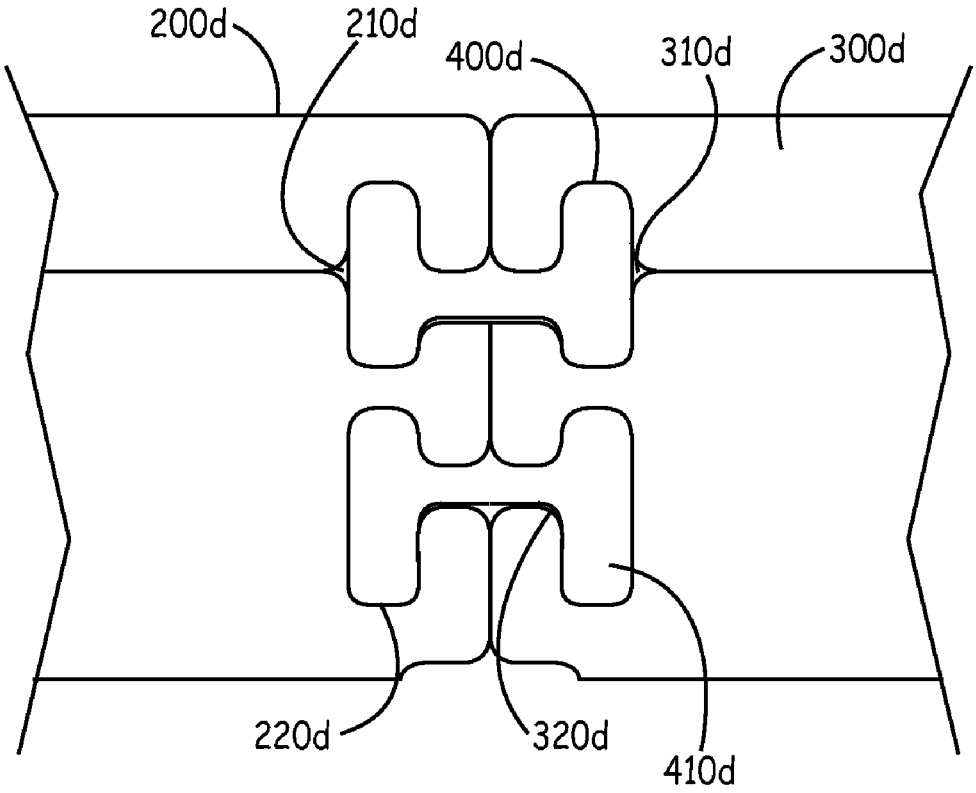

FIG. 20D shows another alternative embodiment of a connector beam in accordance with an implementation of the technology disclosed herein.

Figure 20E:
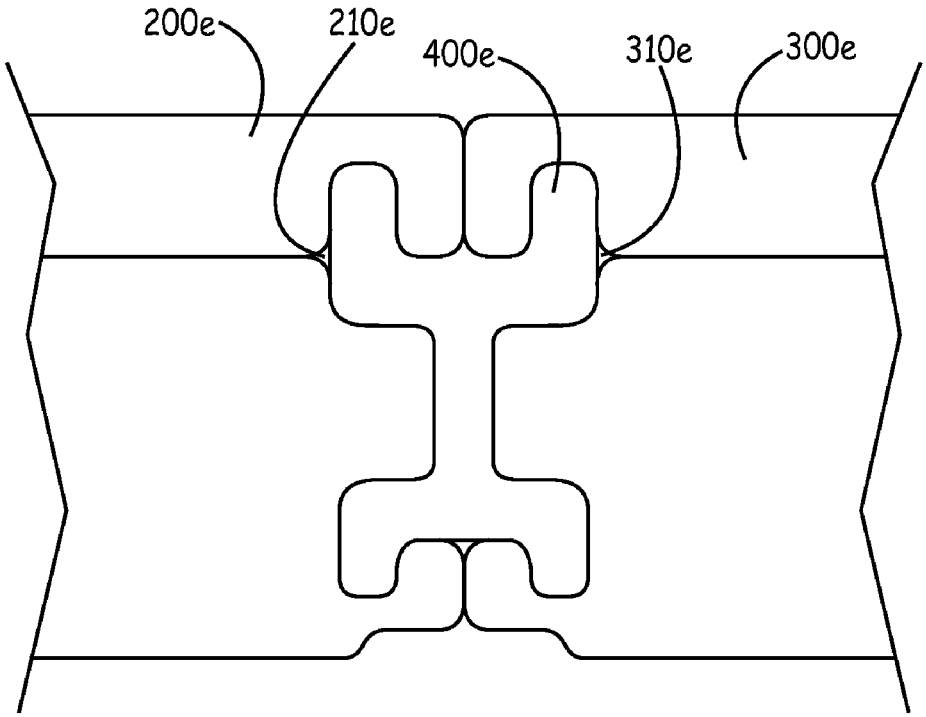

FIG. 20E shows another alternative embodiment of a connector beam in accordance with an implementation of the technology disclosed herein.

Figure 20F:
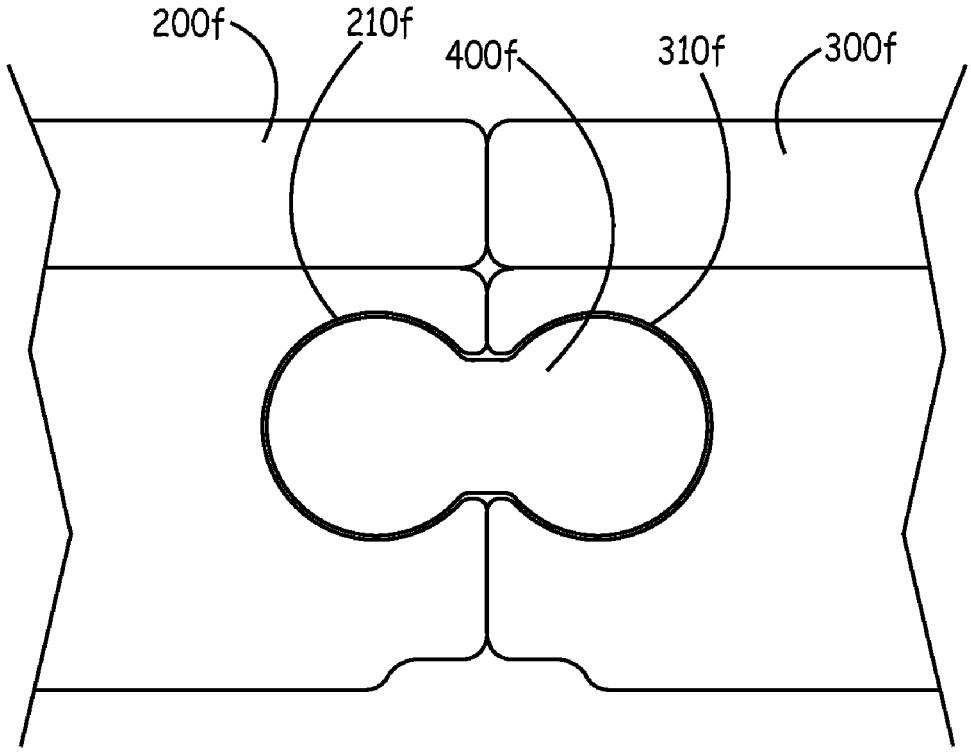

FIG. 20F shows another alternative embodiment of a connector beam in accordance with an implementation of the technology disclosed herein.

Figure 20G:
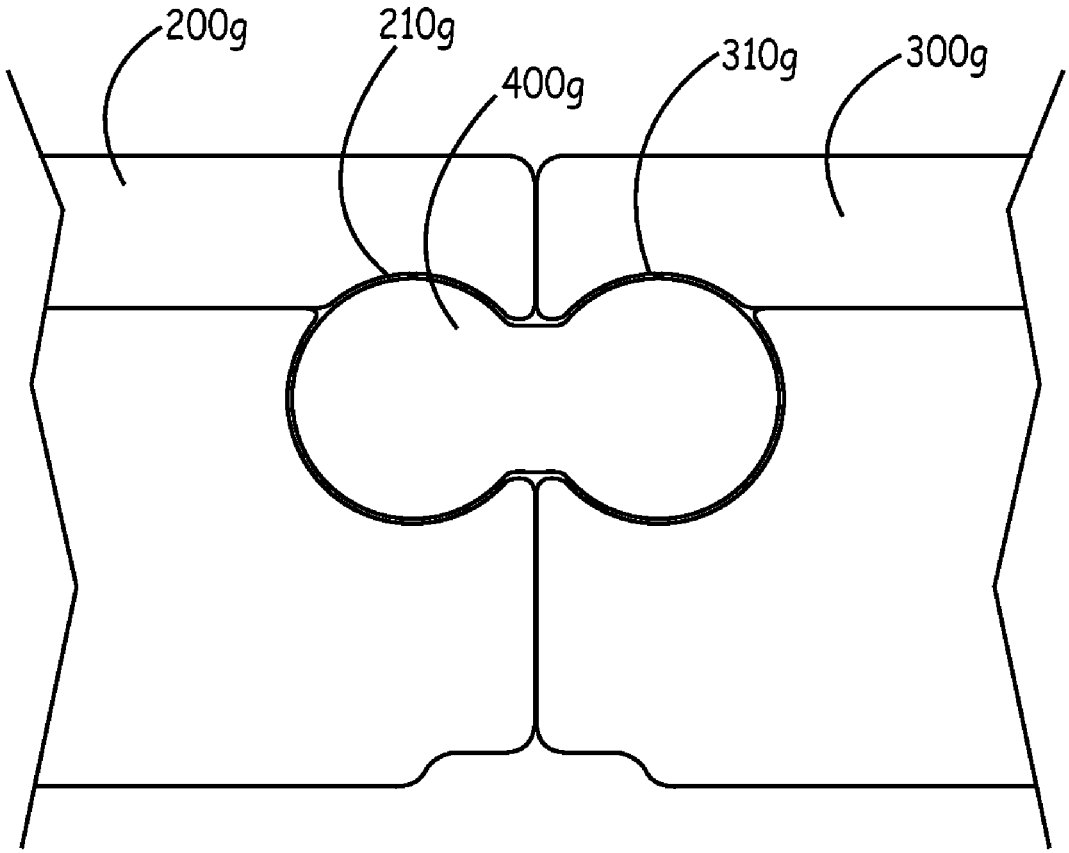

FIG. 20G shows another alternative embodiment of a connector beam in accordance with an implementation of the technology disclosed herein.

Figure 21:
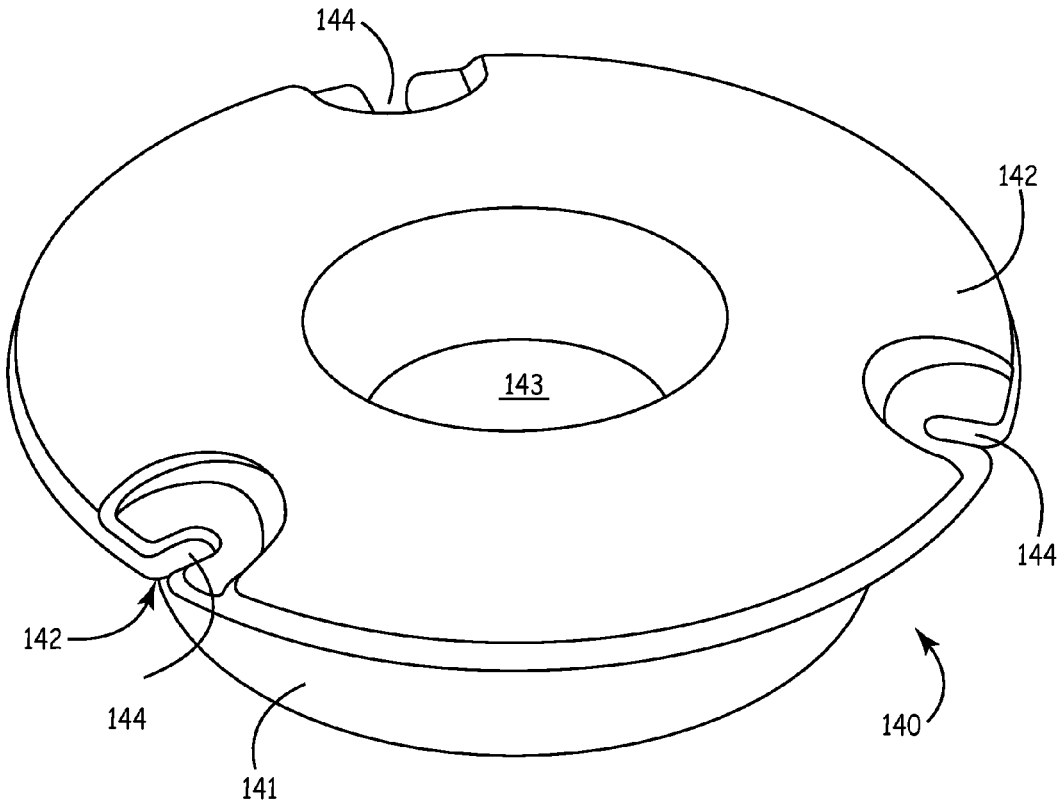

FIG. 21 is an example post adapter in accordance with an implementation of the technology disclosed herein.

Figure 22:
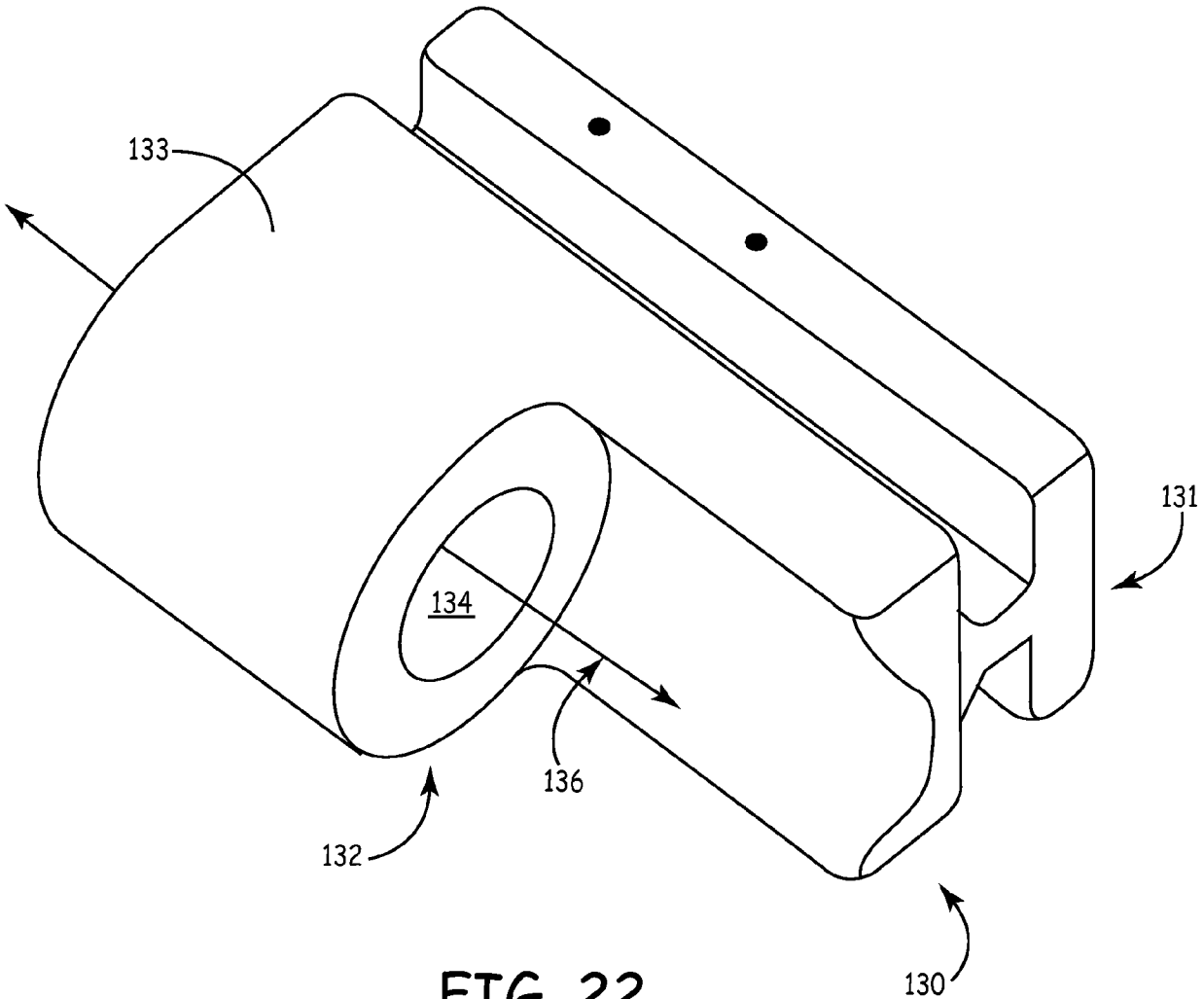

FIG. 22 is a hinge accessory in accordance with an implementation of the technology disclosed herein.

Figure 23:
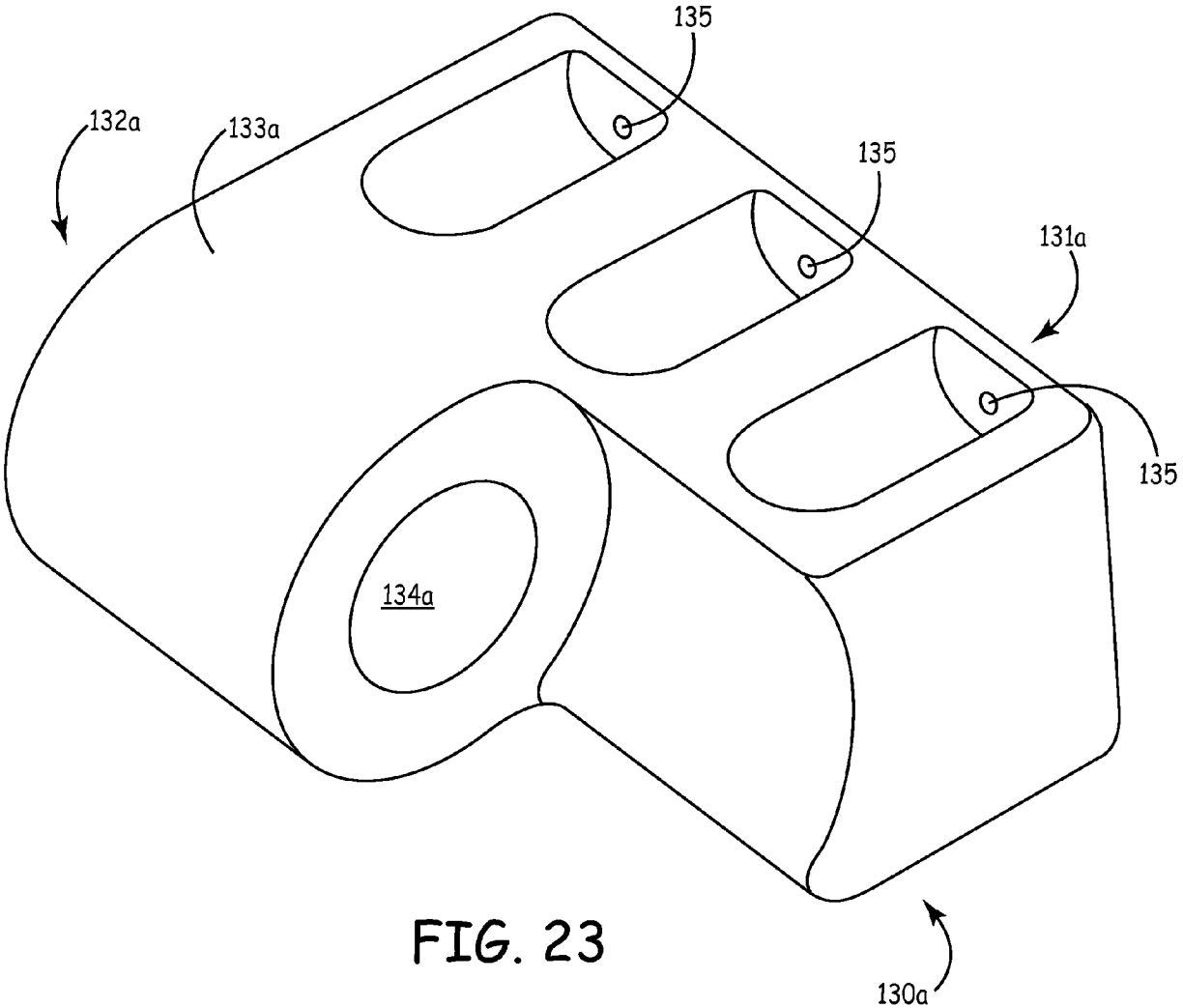

FIG. 23 is an alternative example hinge accessory in accordance with an implementation of the technology disclosed herein.

Figure 24:
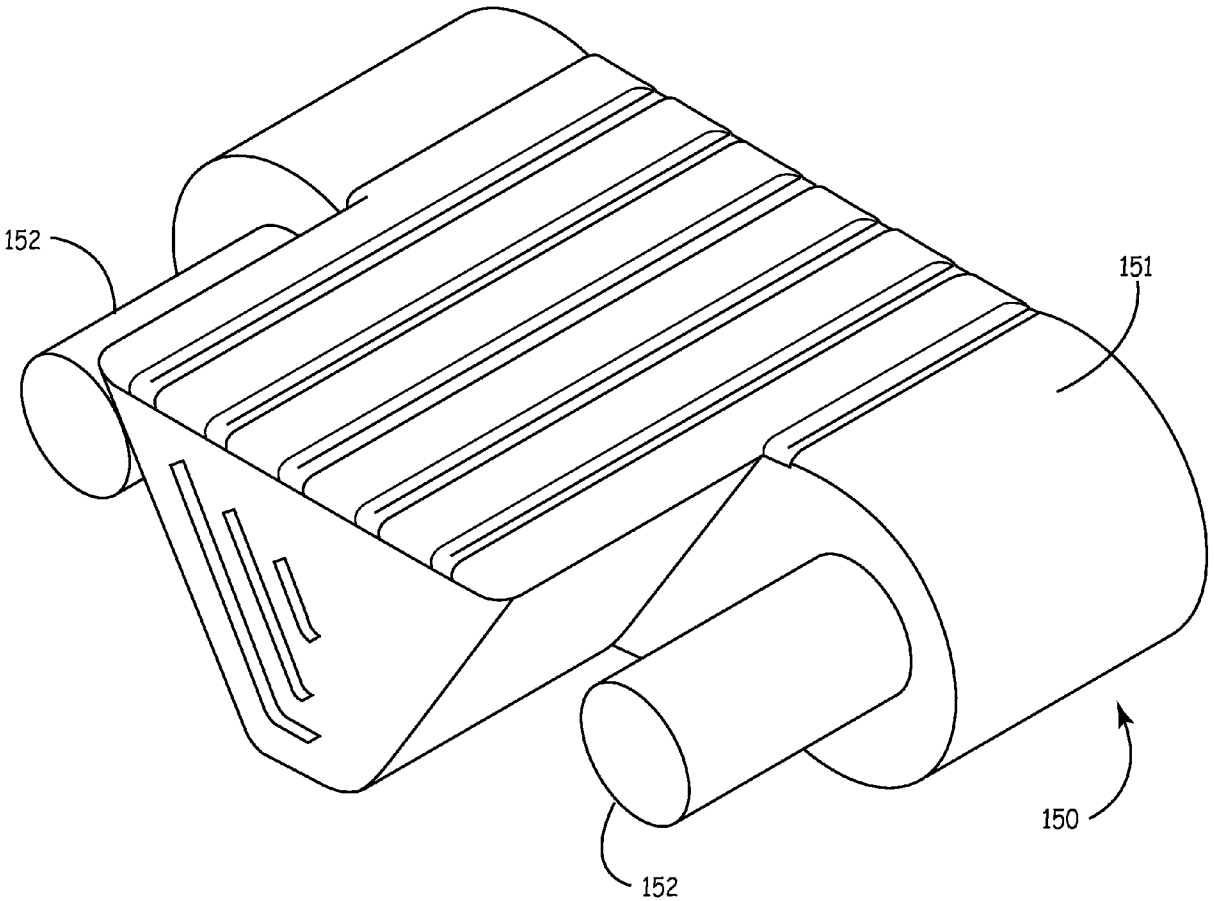

FIG. 24 is an example component that can be coupled to a hinge in accordance with an implementation of the technology disclosed herein.

Figure 25:
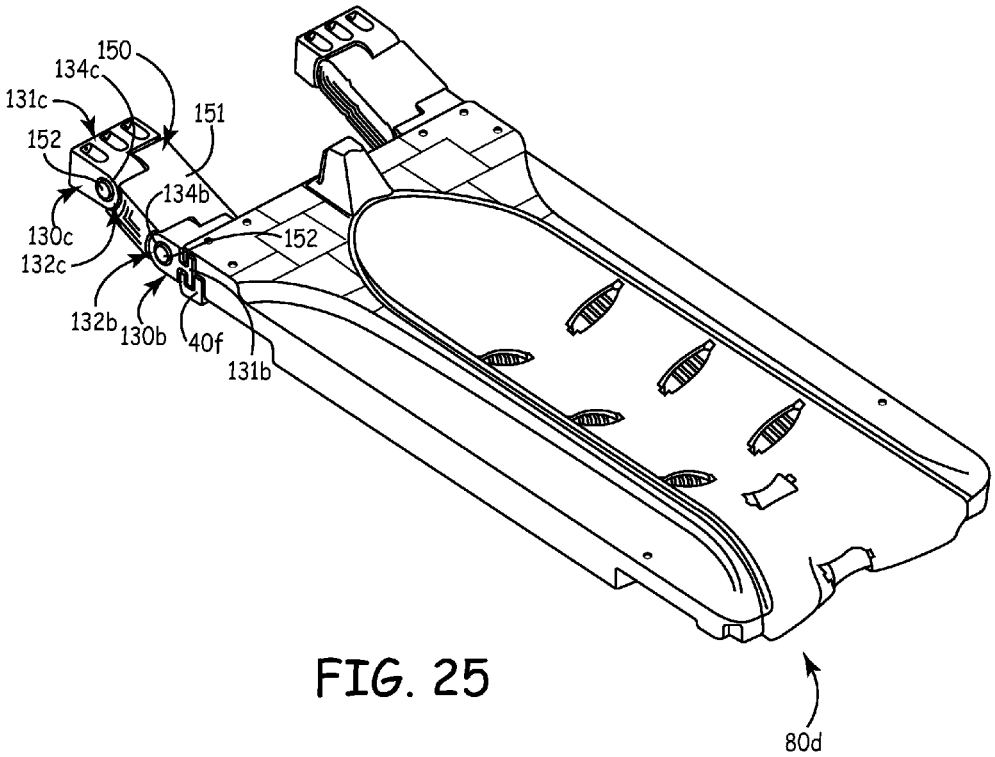

FIG. 25 is an example implementation of the component depicted in FIG. 27*a* according to an implementation of the technology disclosed herein.

Figure 26:
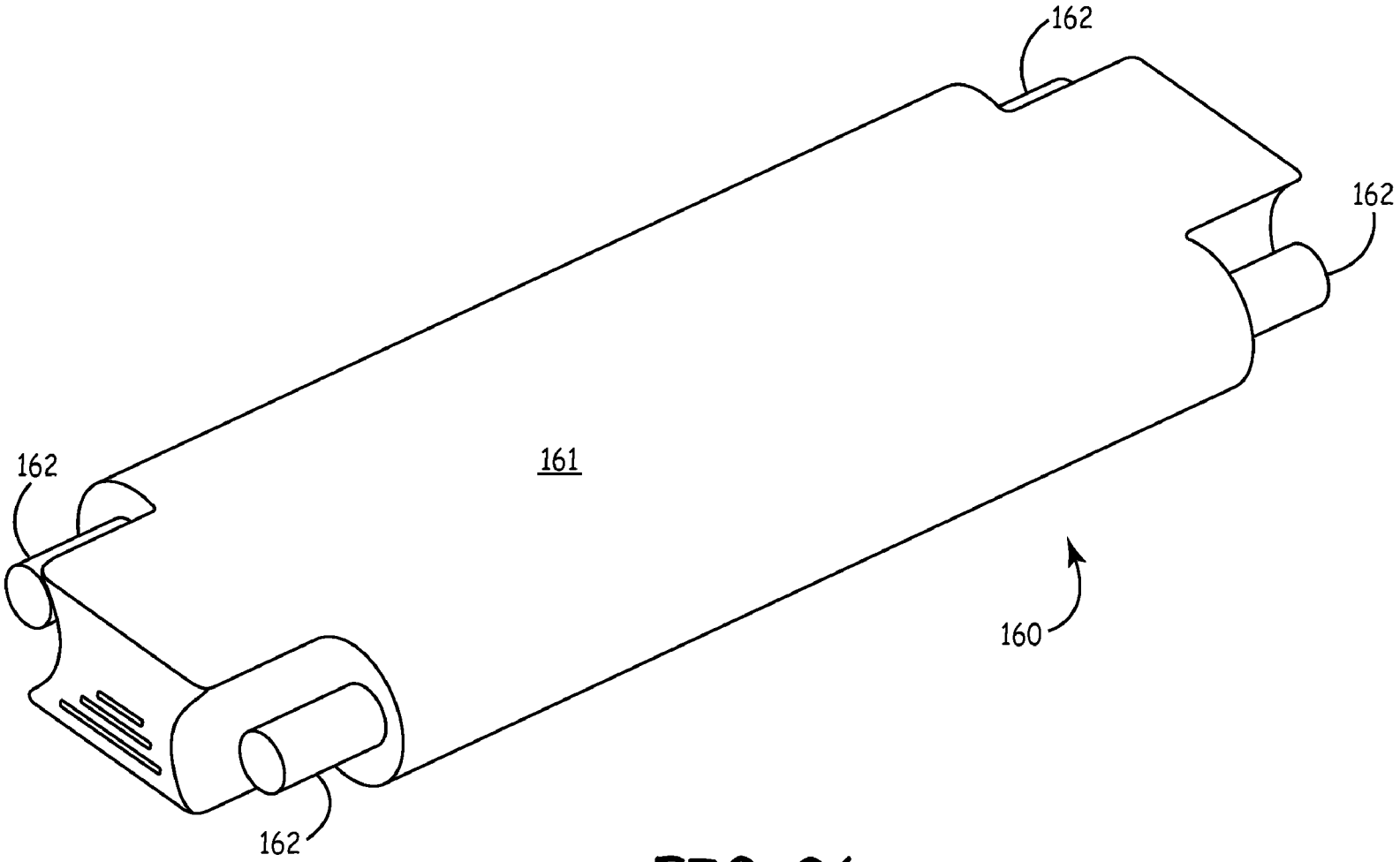

FIG. 26 another example component that can be coupled to a hinge in accordance with an implementation of the technology disclosed herein.

Figure 27:
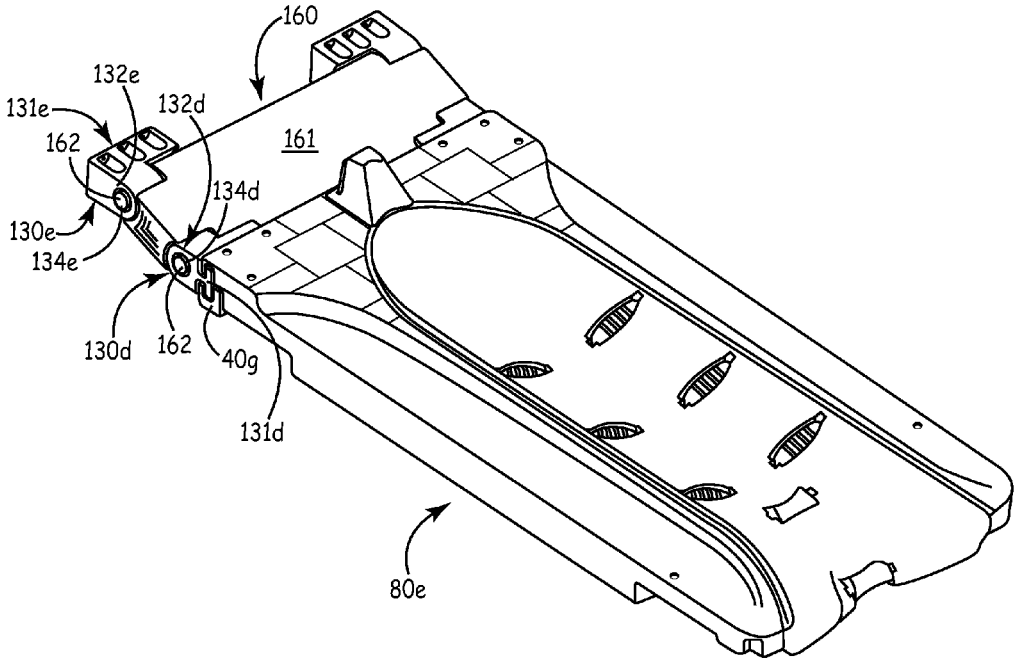

FIG. 27 is an example implementation of the component depicted in FIG. 28*a* according to an implementation of the technology disclosed herein.

Figure 28:
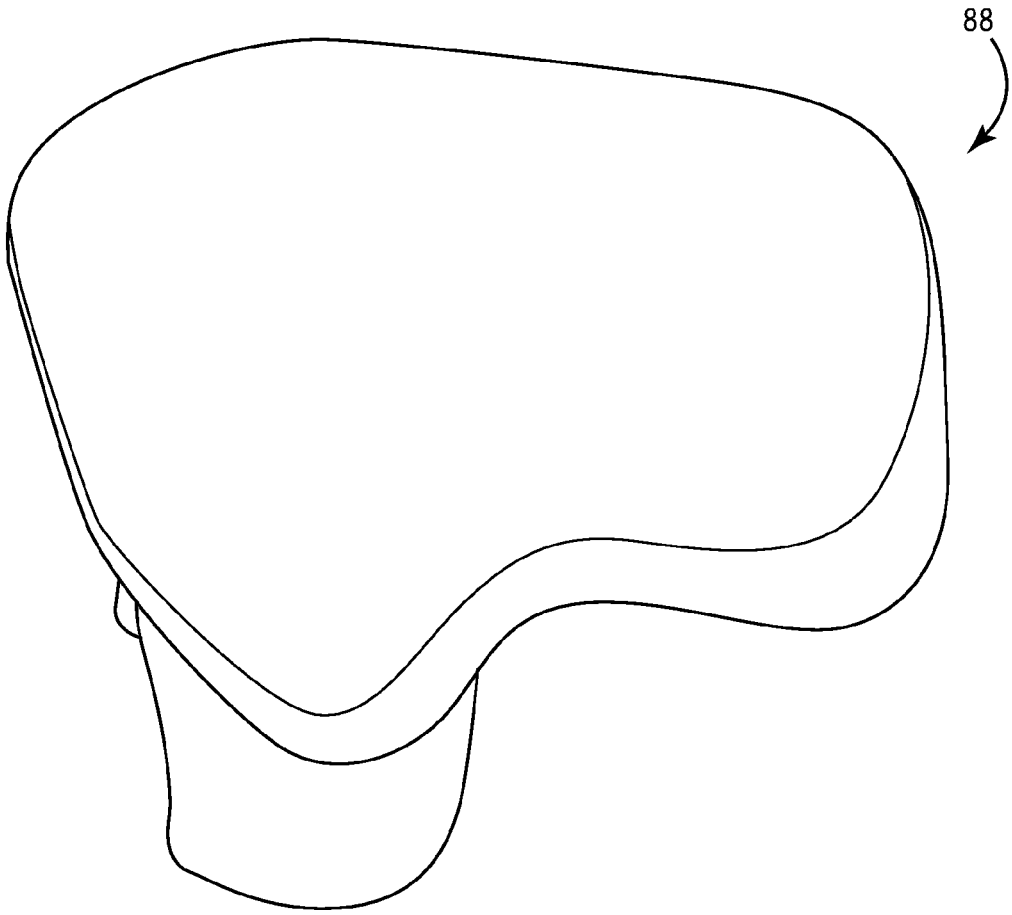

FIG. 28 is an example entrance slide in accordance with an implementation of the technology disclosed herein.

Figure 29:
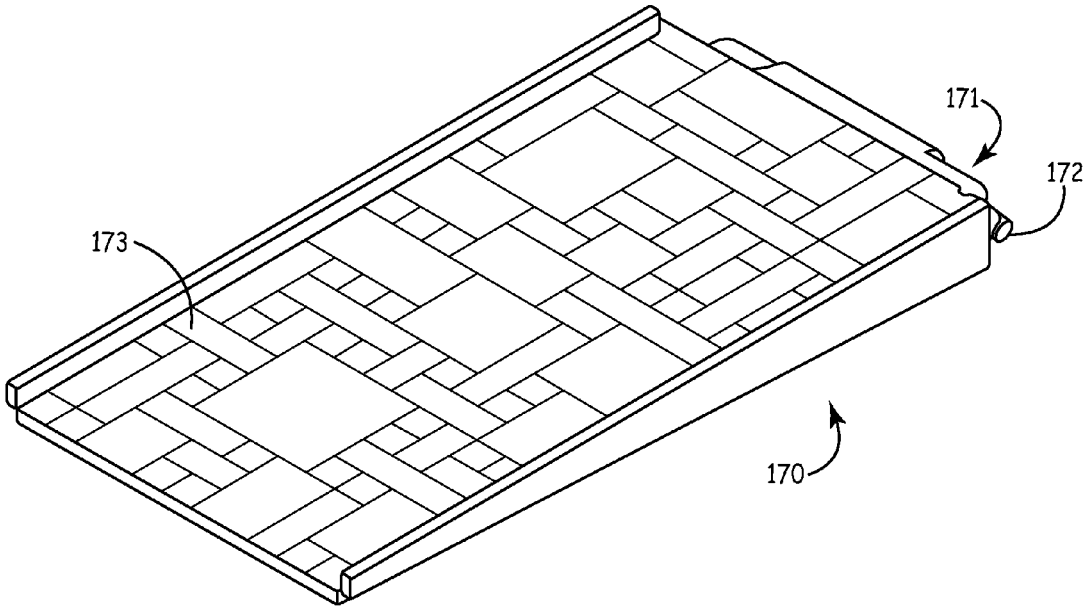

FIG. 29 is an example accessory in accordance with an implementation of the technology disclosed herein.

Figure 30:
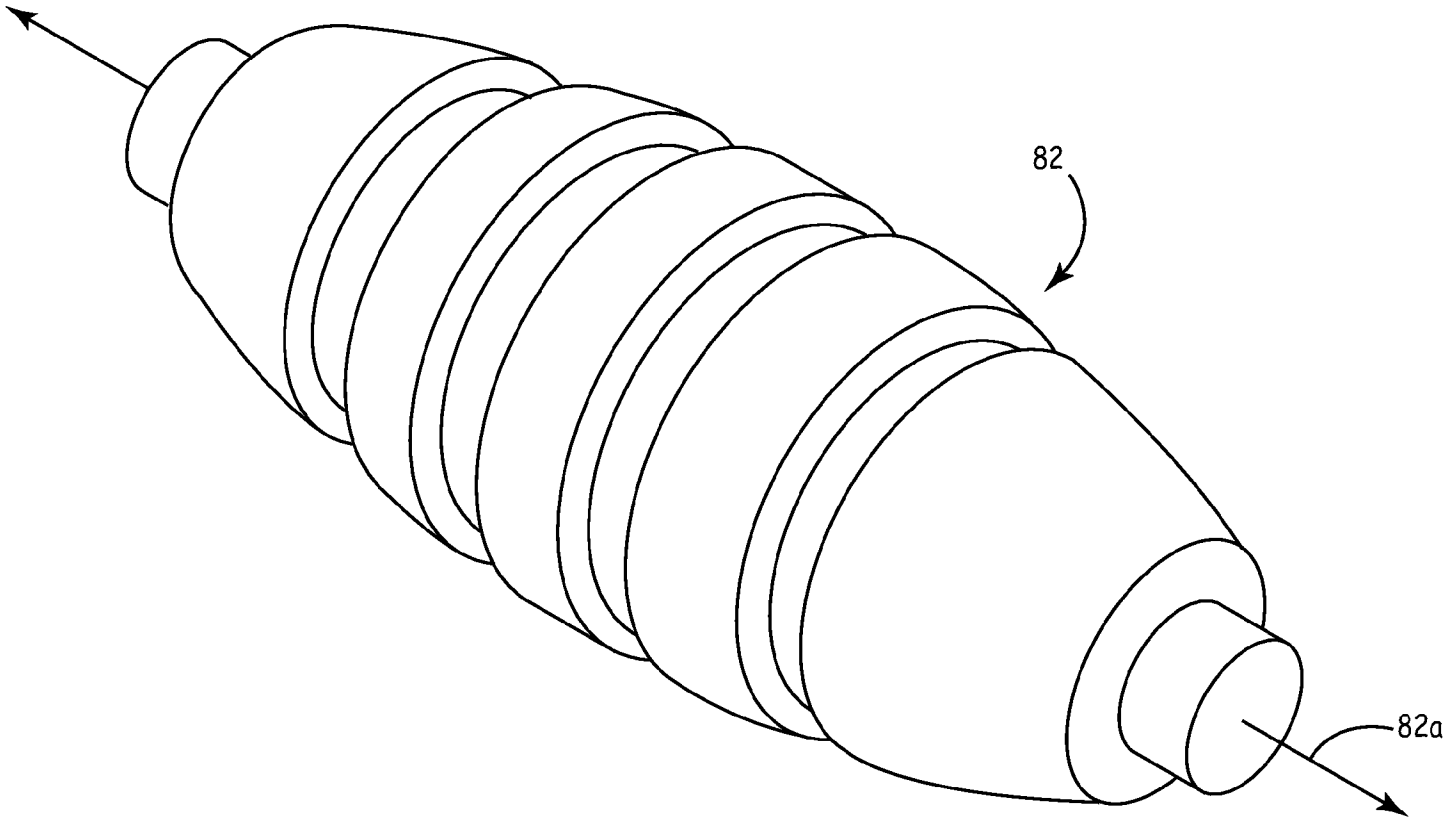

FIG. 30 is a standard roller in accordance with an implementation of the technology disclosed herein.

Figure 31:
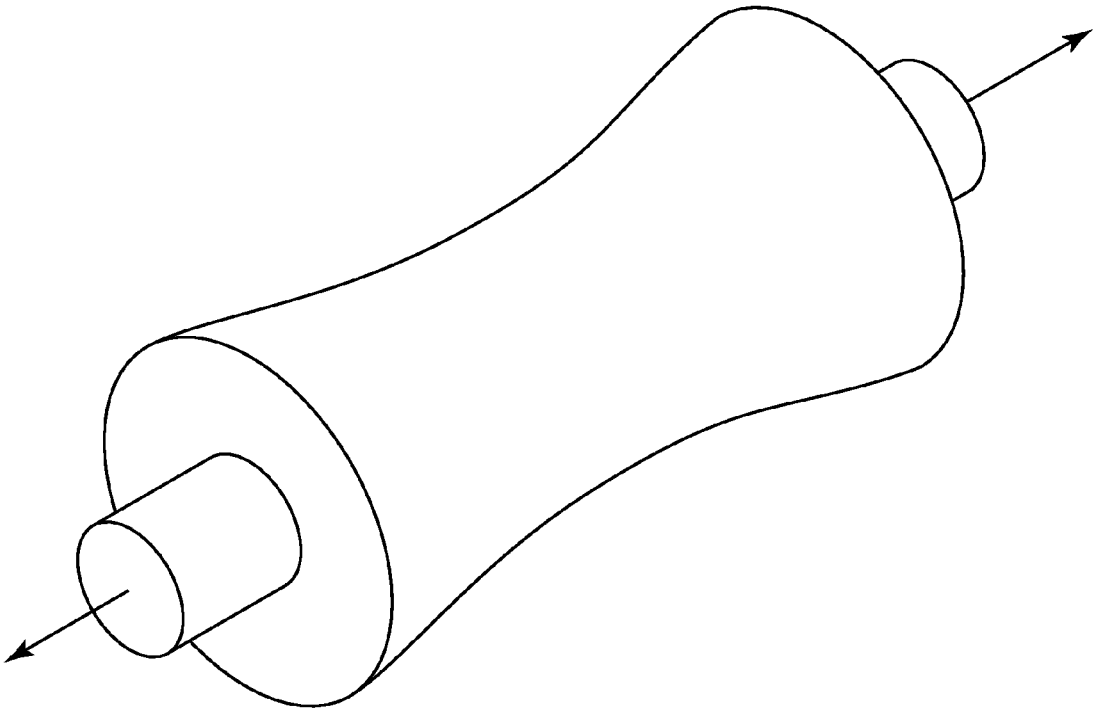

FIG. 31 is an example front roller in accordance with an implementation of the technology disclosed herein.

Figure 32:
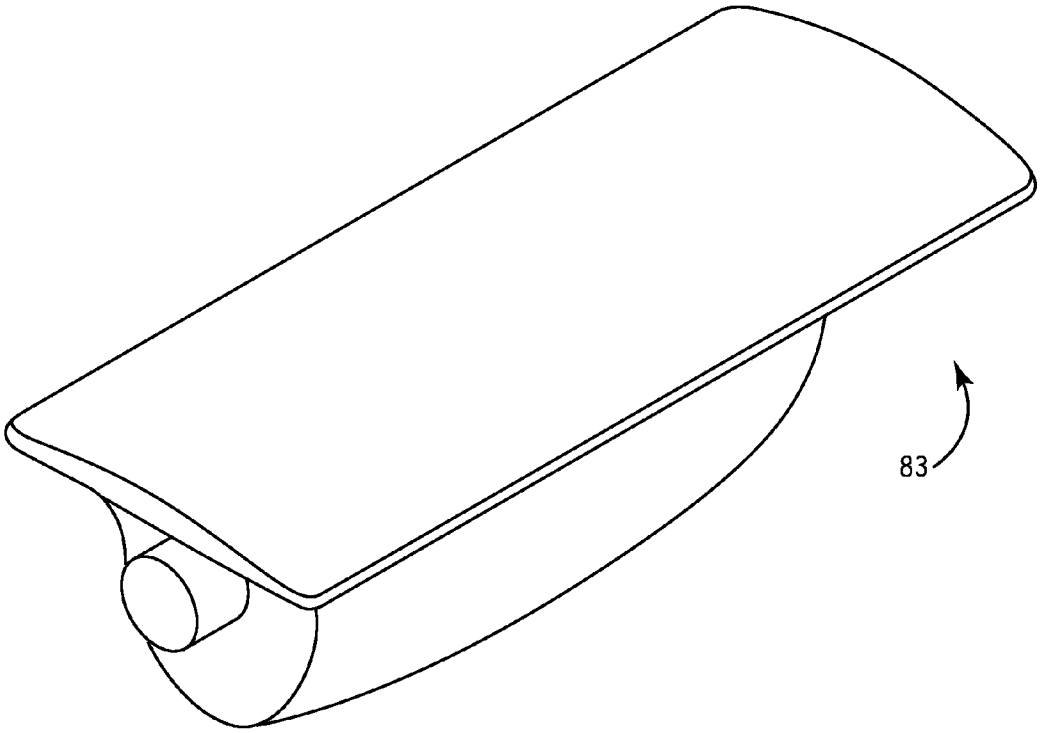

FIG. 32 is an example roller plug in accordance with an implementation of the technology disclosed herein.

Figure 33:
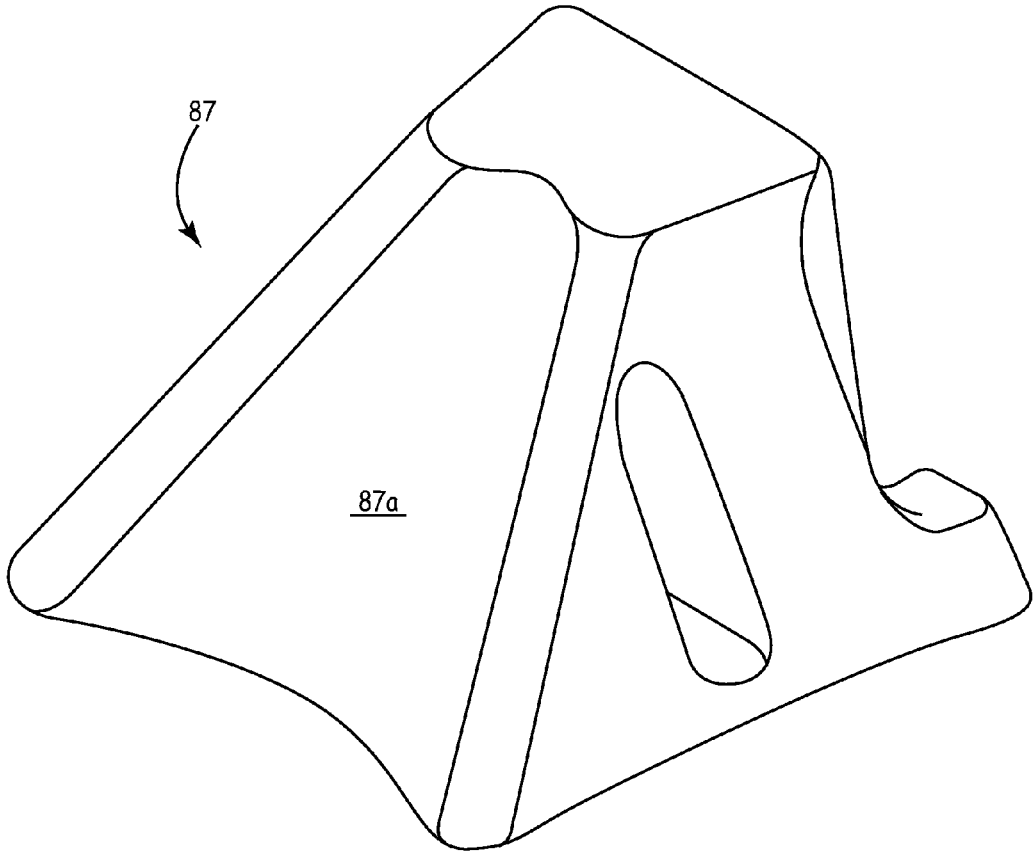

FIG. 33 is an example bow stop in accordance with an implementation of the technology disclosed herein.

Figure 34:
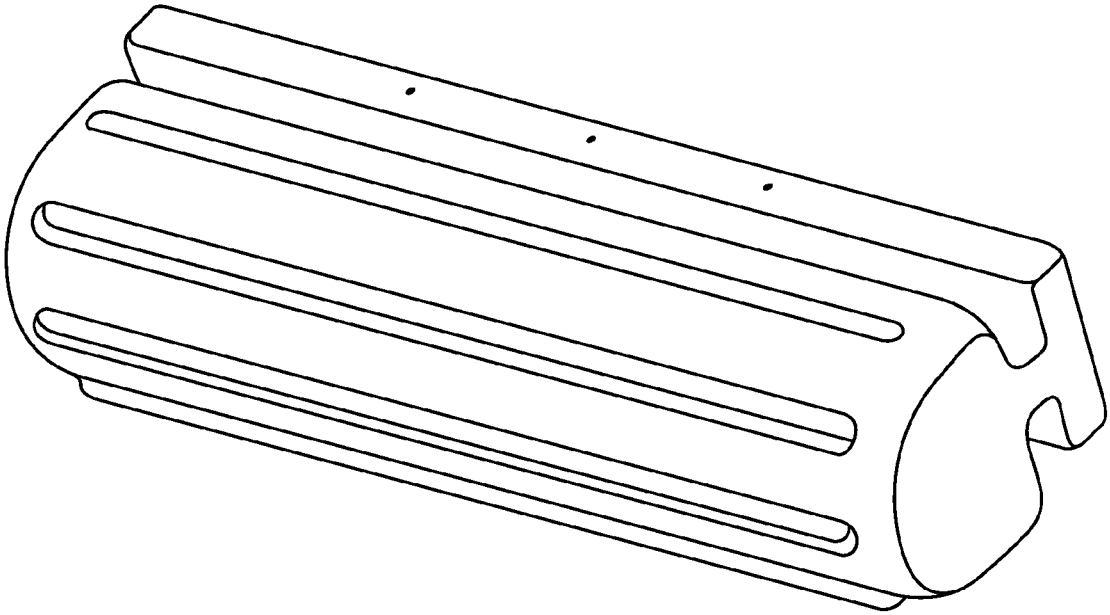

FIG. 34 is an example horizontal bumper in accordance with an implementation of the technology disclosed herein.

Figure 35:
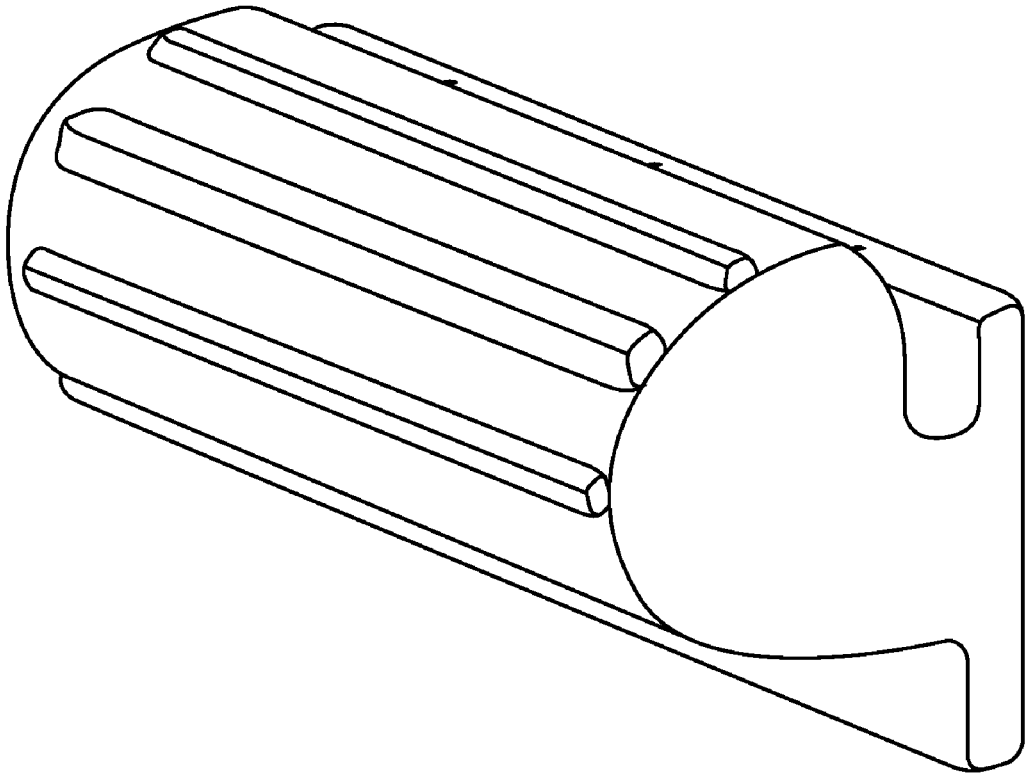

FIG. 35 is another example horizontal bumper in accordance with an implementation of the technology disclosed herein.

Figure 36A:
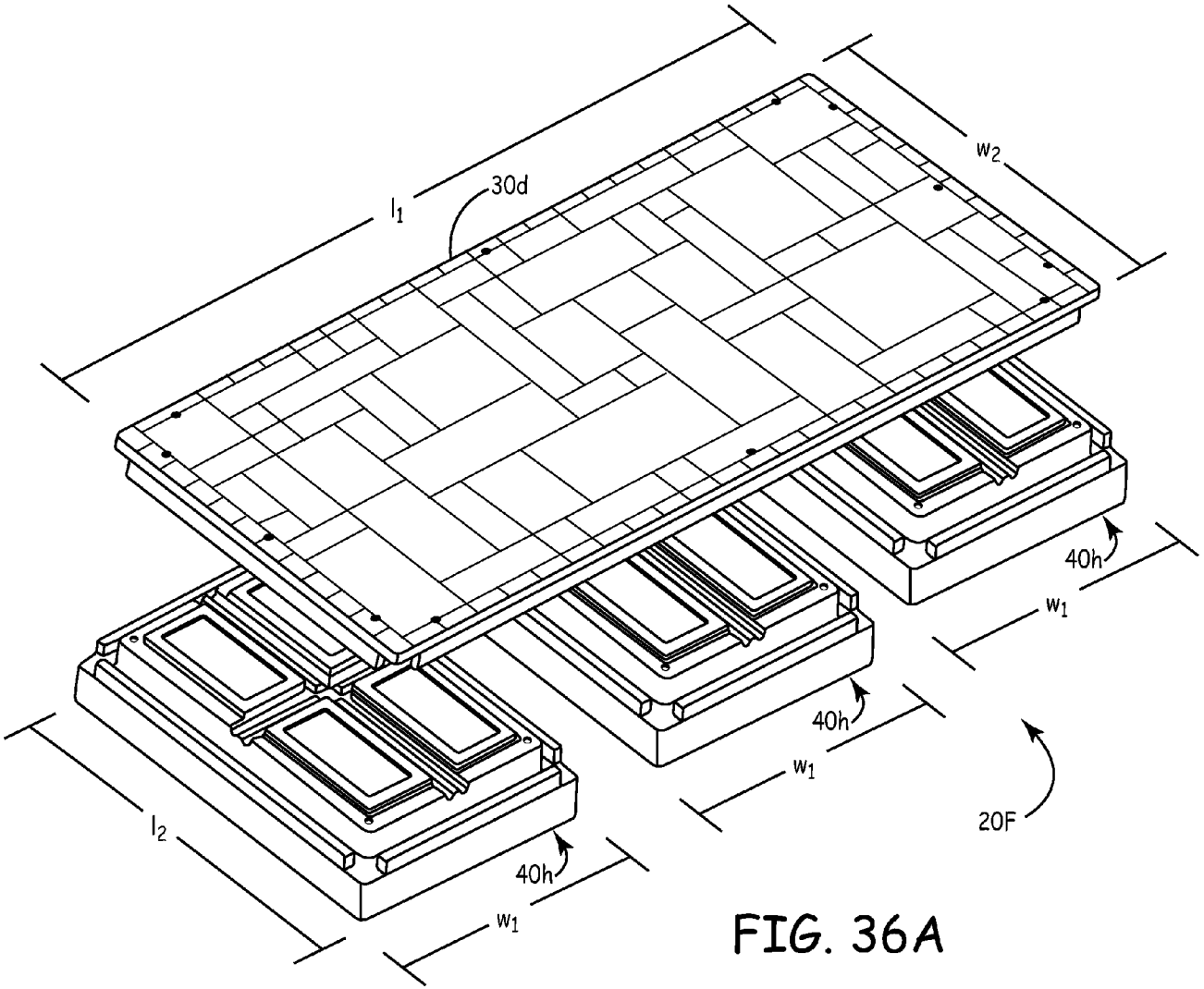

FIG. 36A shows an exploded view of a complete rectangular dock section made in accordance with an implementation of the technology disclosed herein.

Figures 36B, 36C:
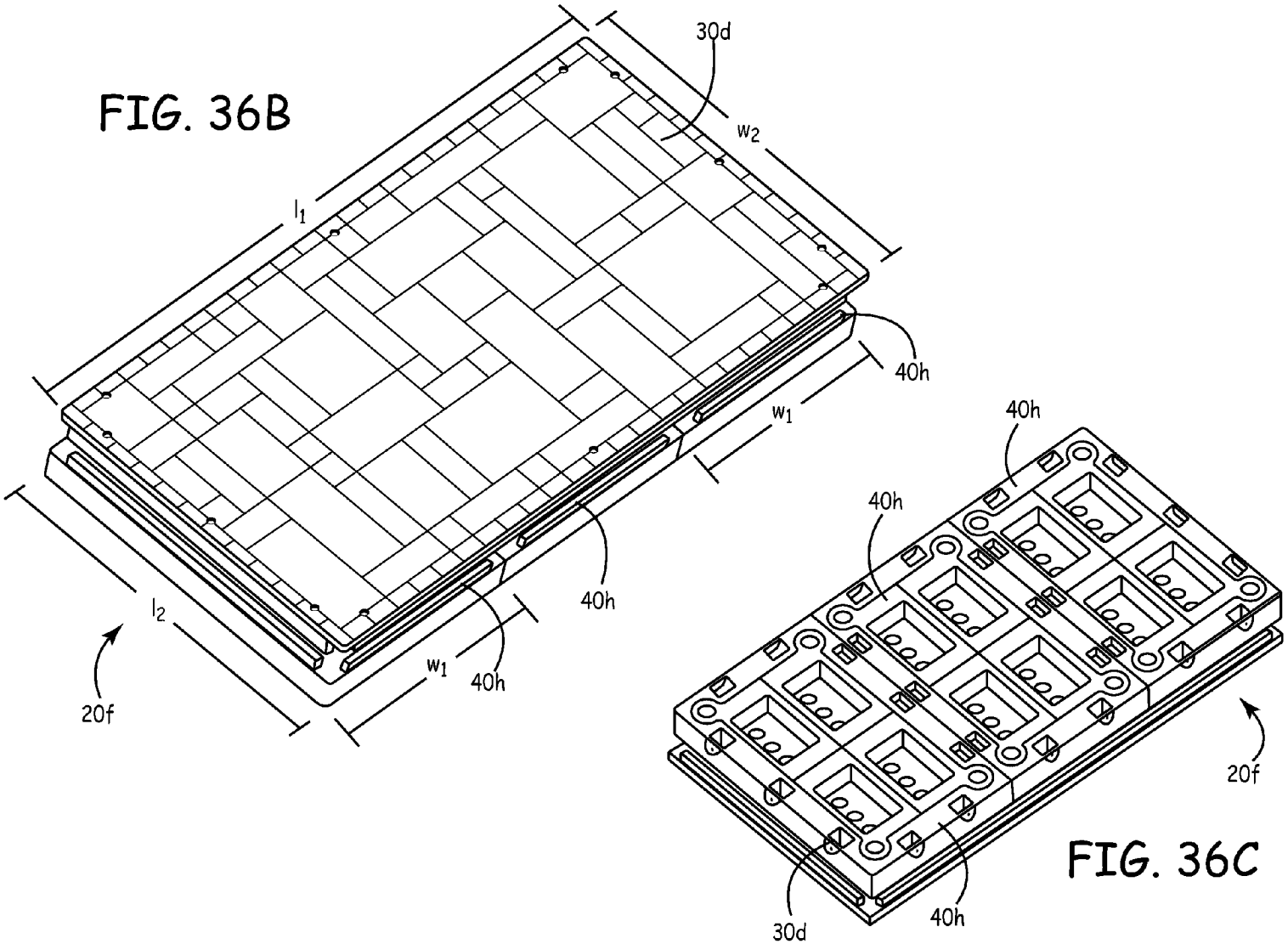

FIG. 36B shows a top perspective view of the assembled complete rectangular dock section of FIG. 36A.

FIG. 36C shows a bottom perspective view of the assembled complete rectangular dock section of FIG. 36A and FIG. 36B.

Figure 37B:
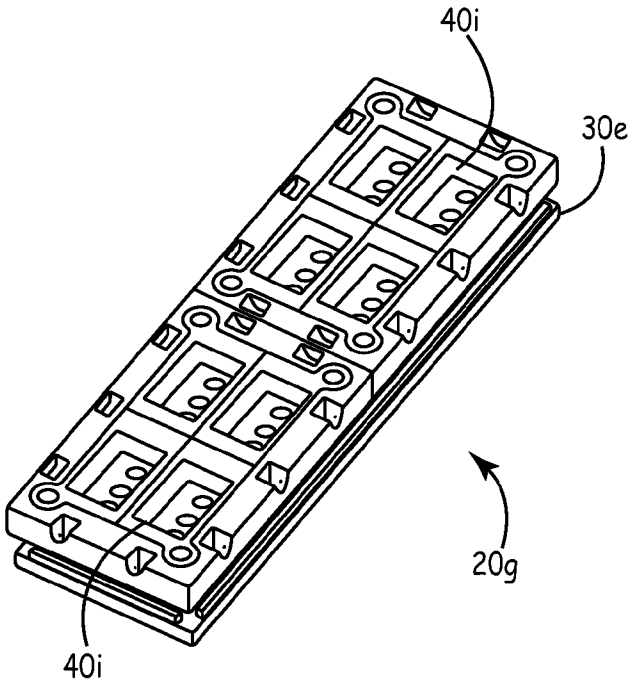
Figure 37A:
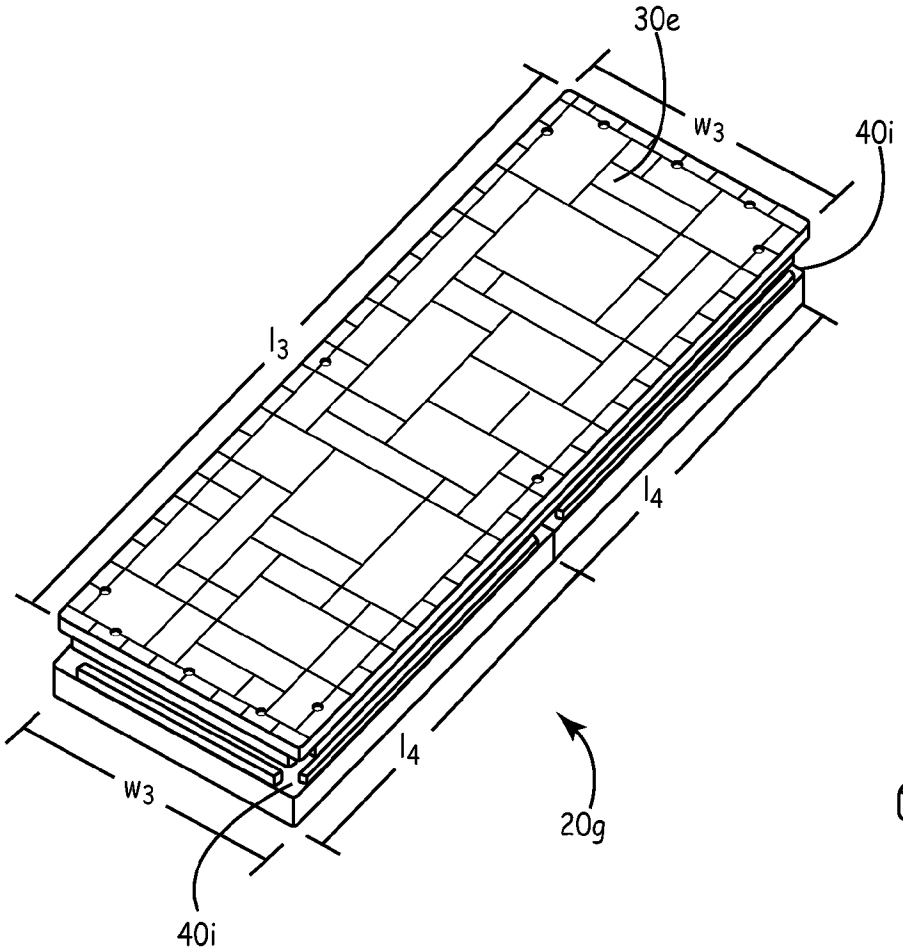

FIG. 37A shows a top perspective view of another embodiment of an assembled complete rectangular dock section made in accordance with an implementation of the technology disclosed herein.

FIG. 37B shows a bottom perspective view of the assembled complete rectangular dock section of FIG. 37A.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION

Figure 1:
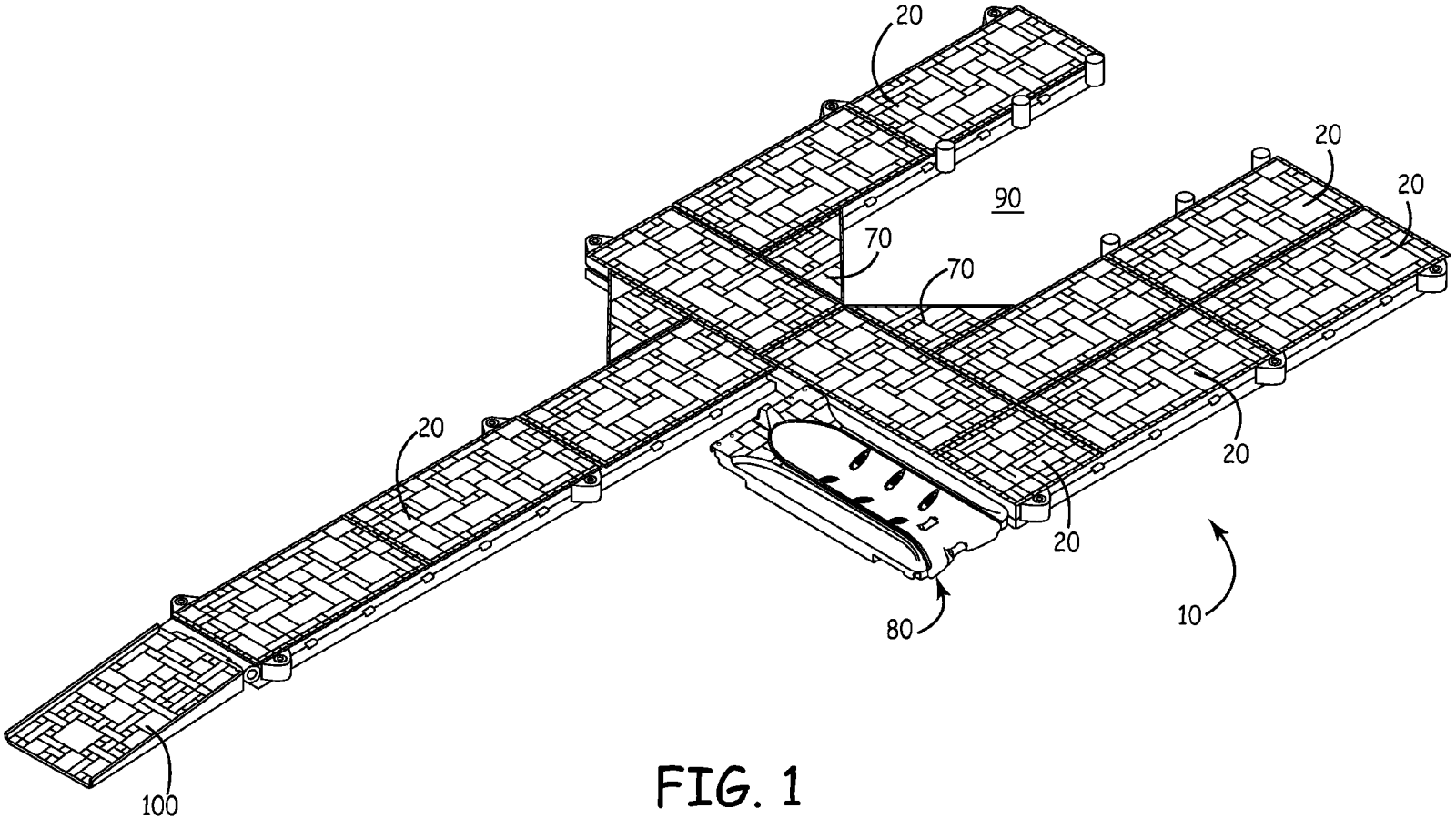
FIG. 1 shows a floating dock system made in accordance with an implementation of the invention, the floating dock system having multiple connected rectangular sections, three triangular sections, and a personal watercraft port.

In reference now to the figures, various embodiments and implementations of the invention are depicted. Referring first to FIG. 1, a floating dock system made in accordance with an implementation of the invention is depicted. The floating dock system 10 is constructed of twelve rectangular sections 20, three triangular sections 70, a personal watercraft port 80, and a ramp 100. The floating dock system 10 in the depicted embodiment is constructed to define a central bay 90. In various embodiments a boat or other watercraft can be stored in the central bay 90.

Each of the rectangular sections 20, triangular sections 70, watercraft port 80, and ramp 100 are configured to removably couple along one or more edges. The components of the technology disclosed herein allow customized construction of a floating dock system 10 having various configurations, depending upon personal needs, requirements, and restrictions in each particular instance where the floating dock system 10 is employed. For example, the length, width, and shape of the floating dock system 10 can be readily changed. Customization can occur when the dock is first installed, after installation, and over time as the dock is expanded and modified.

The rectangular sections 20 and triangular sections 70 can have a variety of shapes and sizes without deviating from the scope of the technology disclosed herein. It will also be understood that other shapes can be created, such as half-circles, pentagons, hexagons, etc. Sides of the rectangular sections 20 and triangular sections 70 can have varying angles, and in various instances other shapes are employed such as squares, circles, half-circles, triangles, hexagons, and so on, that will collectively be referred to as "deck sections" for purposes of this application. The deck sections are described in more detail in the descriptions of FIG. 5, below.

The ramp 100 is generally configured to allow a vehicle to approach the water on the floating dock system 10. The ramp 100 can be employed for a variety of other reasons as well, depending upon personal needs, requirements, and restrictions in each particular instance where the floating dock system 10 is employed. In a particular embodiment the ramp 100 is constructed of polyethylene, although it will be appreciated by those skilled in the art that the ramp 100 can be constructed of a variety of materials including metals, other plastics, fiberglass, and the like.

The port 80 is configured to receive a watercraft. In at least one embodiment the port 80 is configured to receive a personal water craft. In some embodiments the port 80 is configured to receive a canoe or a kayak. In some embodiments the port 80 is configured to receive other watercraft. The port 80 can be at least partially constructed of a foam-filled polyethylene, although some embodiments can be constructed of a foam-filled fiberglass, or the like. The port 80 will be discussed in more detail in the discussion of FIG. 15, below.

Figure 2:
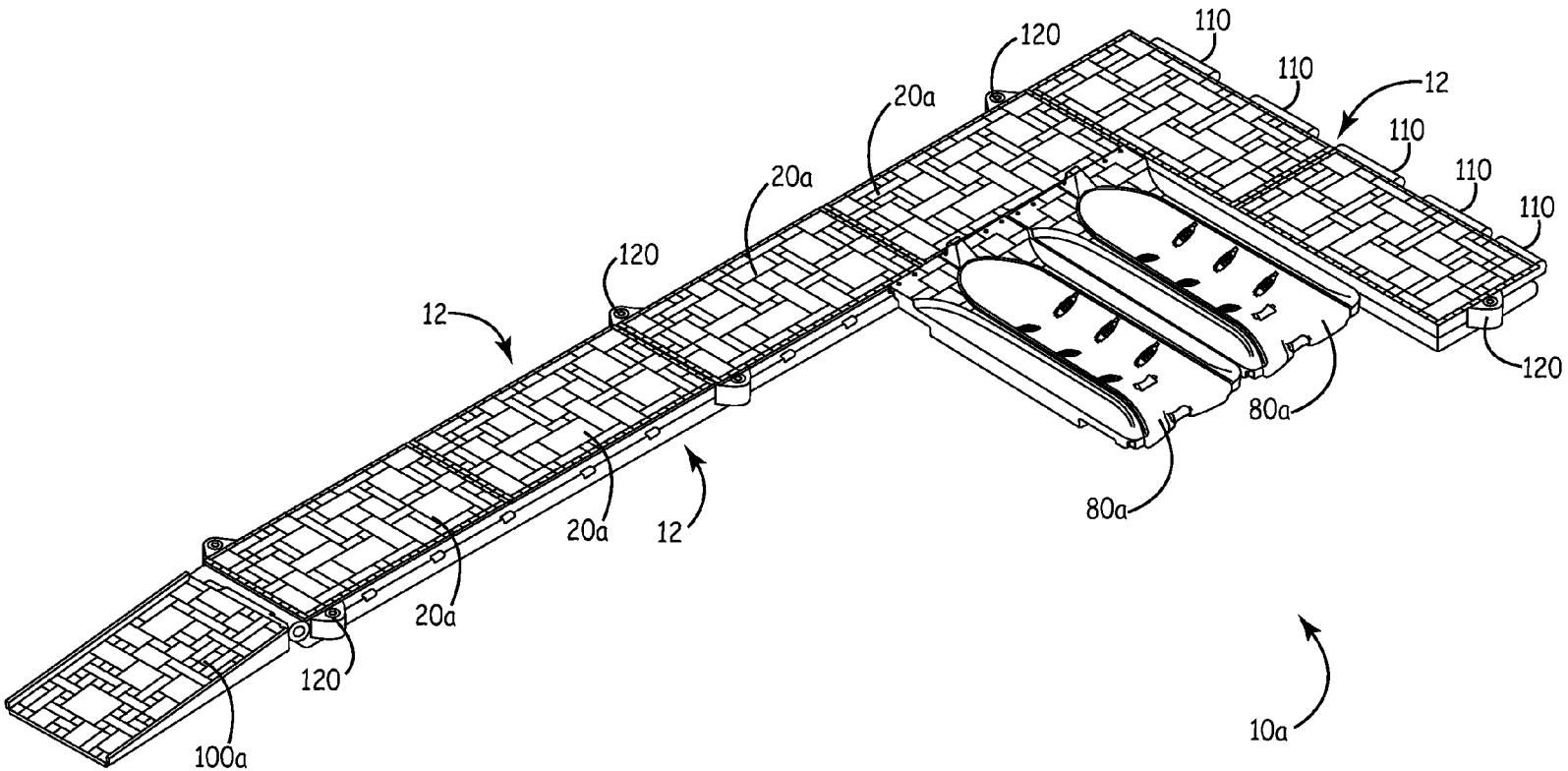
FIG. 2 shows a floating dock system made in accordance with an implementation of the invention, the floating dock system having multiple connected rectangular sections, and two personal watercraft ports.
Figure 3:
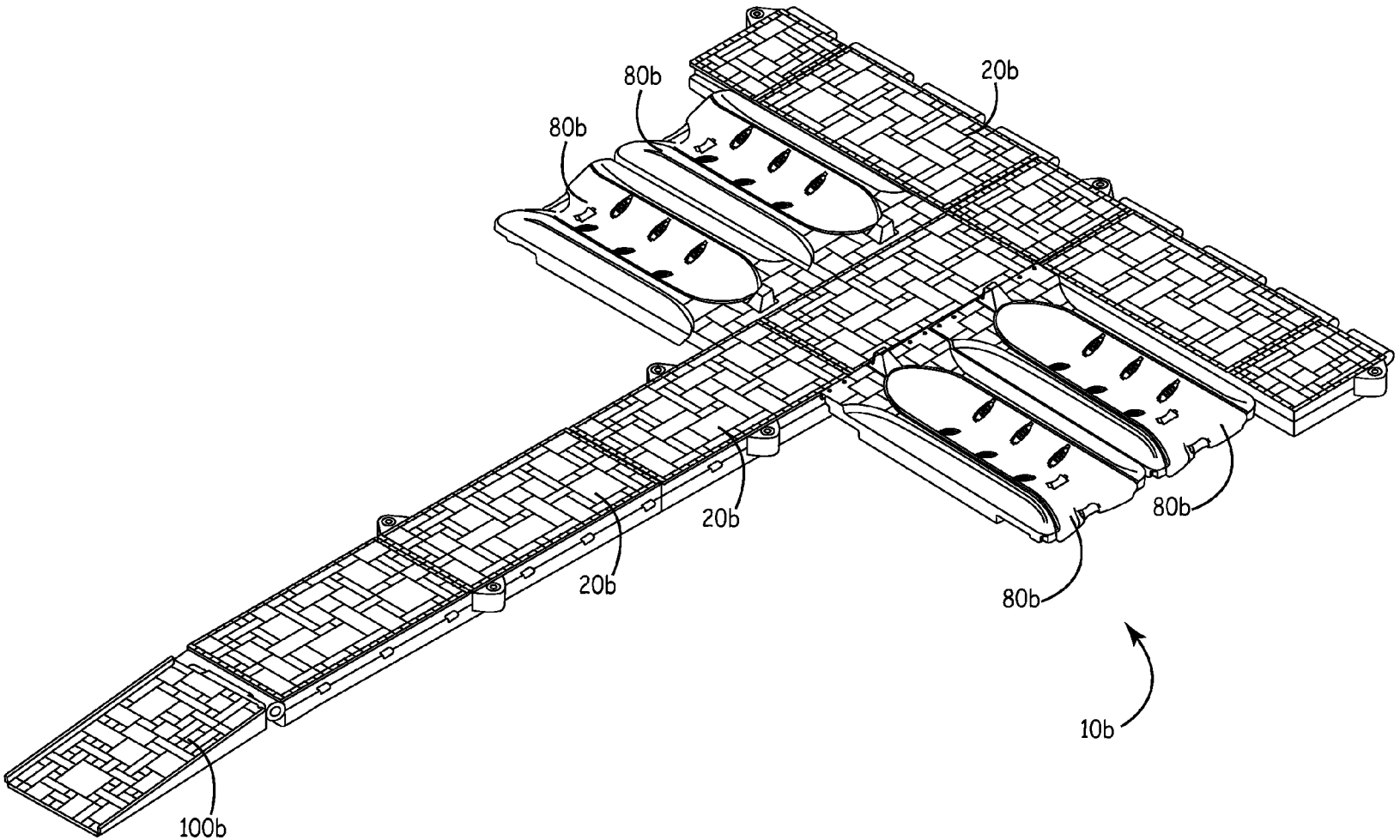
FIG. 3 shows a floating dock system made in accordance with an implementation of the invention, the floating dock system having multiple connected rectangular sections, and four personal watercraft ports.
Figure 4:
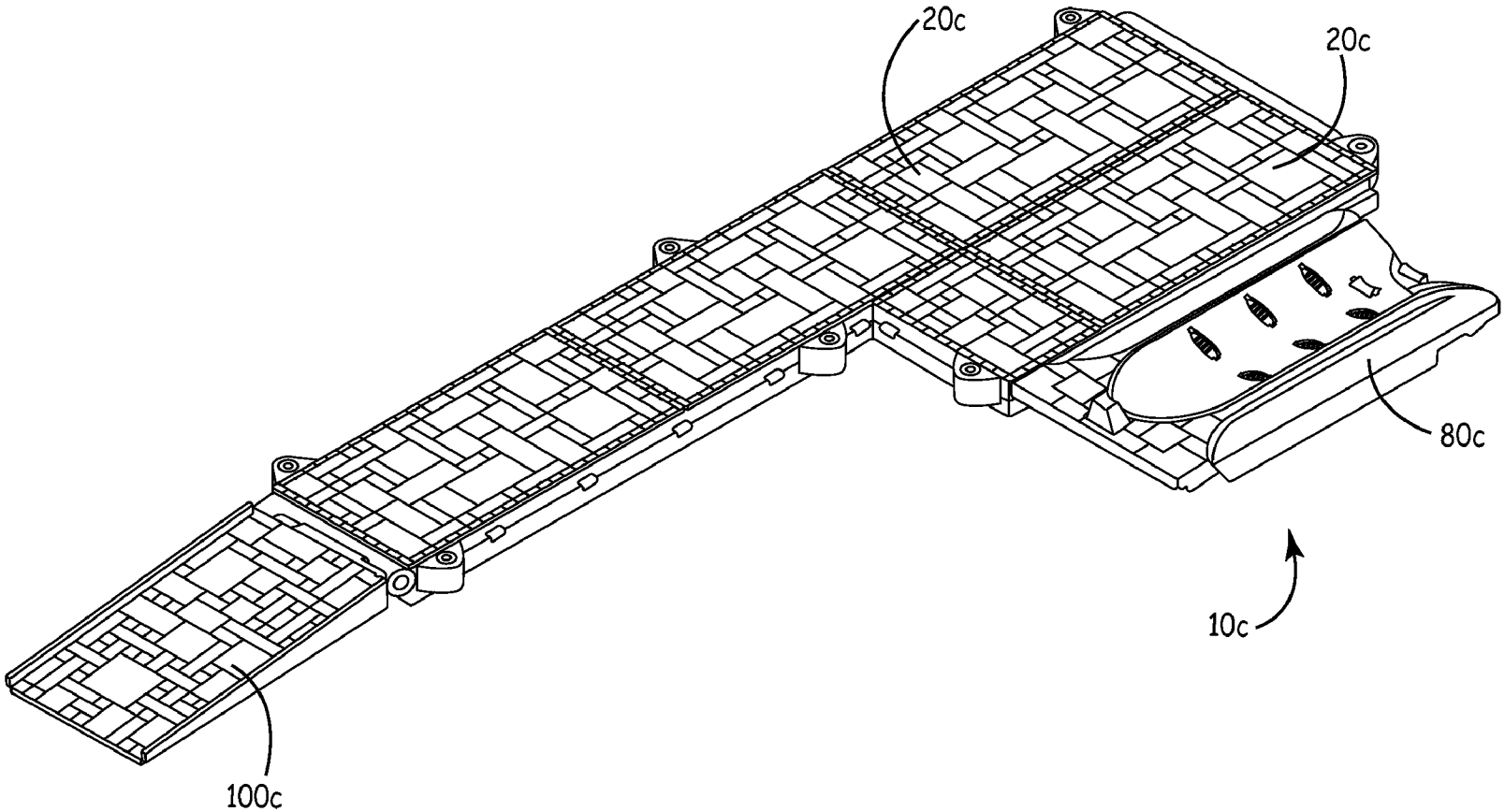
FIG. 4 shows a floating dock system made in accordance with an implementation of the invention, the floating dock system having multiple connected rectangular sections, and a single personal watercraft port.

FIGS. 2 through 4 depict alternative constructions of docking systems in accordance with the present technology. In FIG. 2 the floating dock system 10*a* is constructed of six connected rectangular sections 20*a* in an "L" shape, and two ports 80*a*. In this particular construction the ports 80*a* are shown on the inside of the "L". In some situations such ports' 80*a* locations could provide at least minimal protection from waves and weather. In this particular construction, exposed edges 12 of the rectangular sections 20*a* of the floating dock system 10*a* could be employed for fastening boats, fishing, swimming, or for other purposes.

The dock system 10*a* depicted in FIG. 2 includes a plurality of horizontal bumpers 110 for holding off a boat at the end of the dock system 10*a*. The horizontal bumpers 110 are configured to couple to exposed edges of rectangular sections 20*a*. The horizontal bumpers 110 can have a variety of shapes and sizes, and generally create a space between the exposed edges 12 of the floating dock system 10*a* and an adjacent watercraft. The horizontal bumpers 110 can be constructed of a variety of materials including plastics, foams, fiberglass, and so on. In one embodiment the horizontal bumpers 110 are poly-vinyl. In some instances vertical bumpers can be employed, which will be described in more detail, below. Example horizontal bumpers are depicted in FIGS. 34 and 35.

A series of post adapters 120 are positioned at various points on the dock. The post adapters 120 are configured to receive a post, for example, that holds the floating dock system 10*a* in place, especially in larger bodies of water or places with a current (post adapters are also depicted in the dock systems of FIGS. 1, 3, and 4). In the current embodiment, each post adapter 120 is configured to couple to a portion of an exposed edge of a rectangular section 20*a*. Each post adapter 120 can have a variety of shapes and sizes. Each post adapter 120 defines a post opening that is the size and shape to at least partially accommodate a post. In various embodiments, the post openings have a substantially circular cross section and are substantially cylindrical in shape. A post can then be secured to the floor of the body of water by, for example, inserting it into the floor, and at least partially pass through the central opening of the post adapter 120. The post adapter can be constructed of a variety of materials including metals, plastics, and so on. In at least one embodiment the post adapter 120 is at least partially constructed of polyethylene. The post adapter is depicted in more detail in FIG. 12 and will be discussed below. Other methods of holding the floating dock system 10*a* in place can also be employed.

FIG. 3 depicts another floating dock system 10*b* constructed in accordance with an implementation of the technology disclosed herein. The floating dock system 10*b* is constructed of nine connected rectangular sections 20*b* of a variety of shapes and sizes, one ramp 100*b*, and four ports 80*b*. FIG. 4 also depicts a floating dock system 10*c* made in accordance with an implementation of the technology disclosed herein, the floating dock system 10*c* having five connected rectangular sections 20*c*, a ramp 100*c*, and a single personal watercraft port 80*c*.

Figure 6:
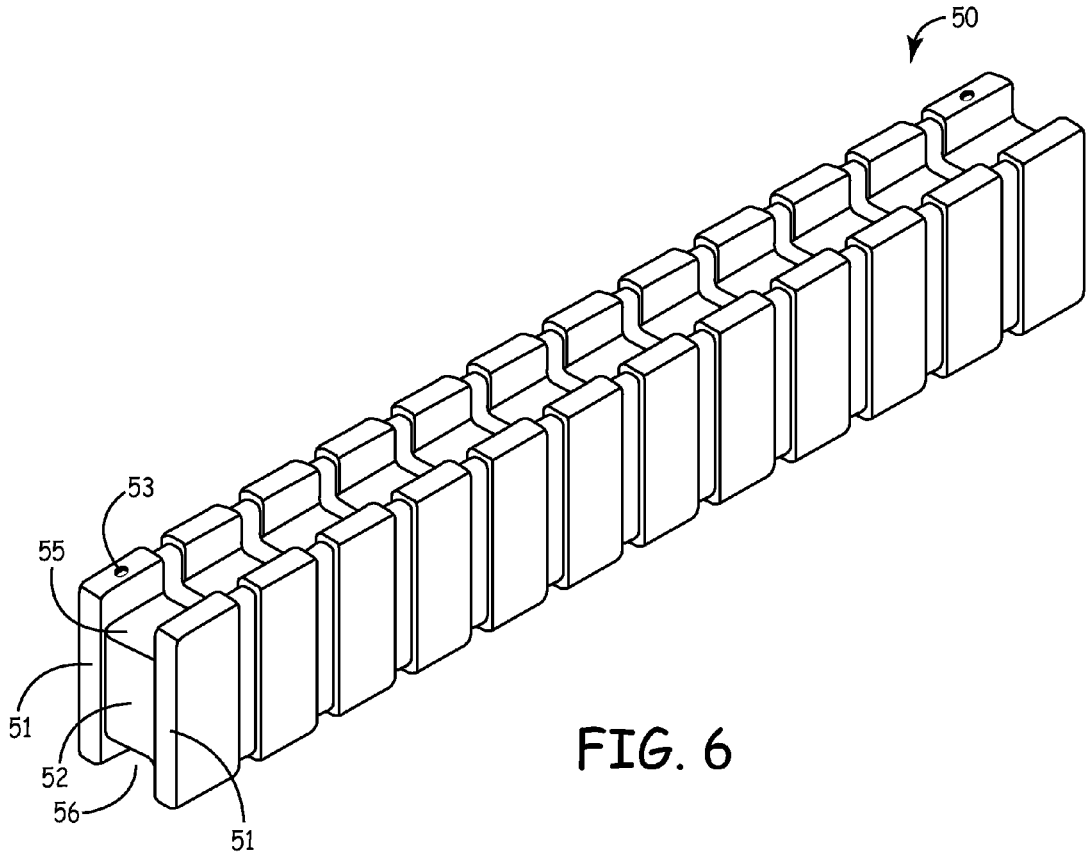
FIG. 6 shows a connector beam for joining dock sections, the connector beam made in accordance with an implementation of the technology disclosed herein.
Figure 7:
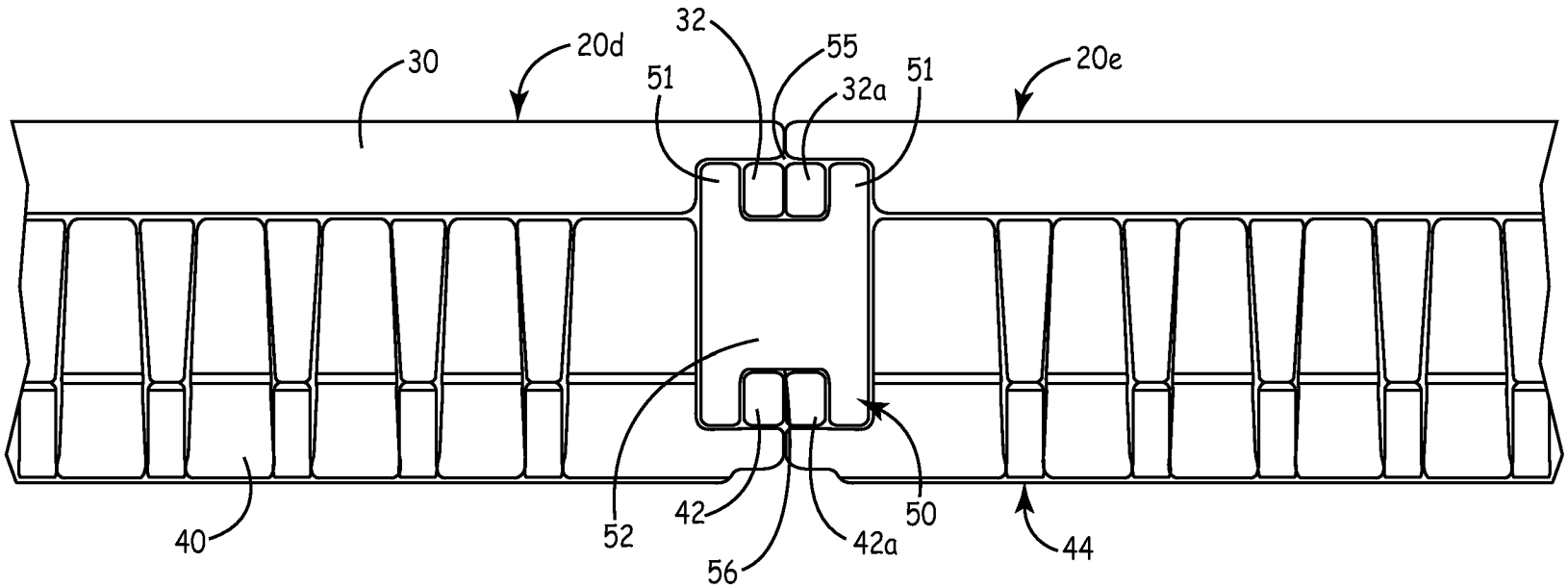
FIG. 7 shows a side elevation view of a connector beam joining two dock sections, the connector beam and dock sections made in accordance with an implementation of the technology disclosed herein.

As discussed earlier, the present technology allows for various docking configurations. This flexibility in configuration is promoted by connector beams that connect the rectangular sections, triangular sections, and other-shaped sections of the dock system. This dock section and connector system is depicted on FIGS. 5 through 7 (and elsewhere). FIG. 6 shows a connector beam for joining dock sections, and FIG. 7 shows a side elevation view of a connector beam joining two dock sections.

Figure 5:
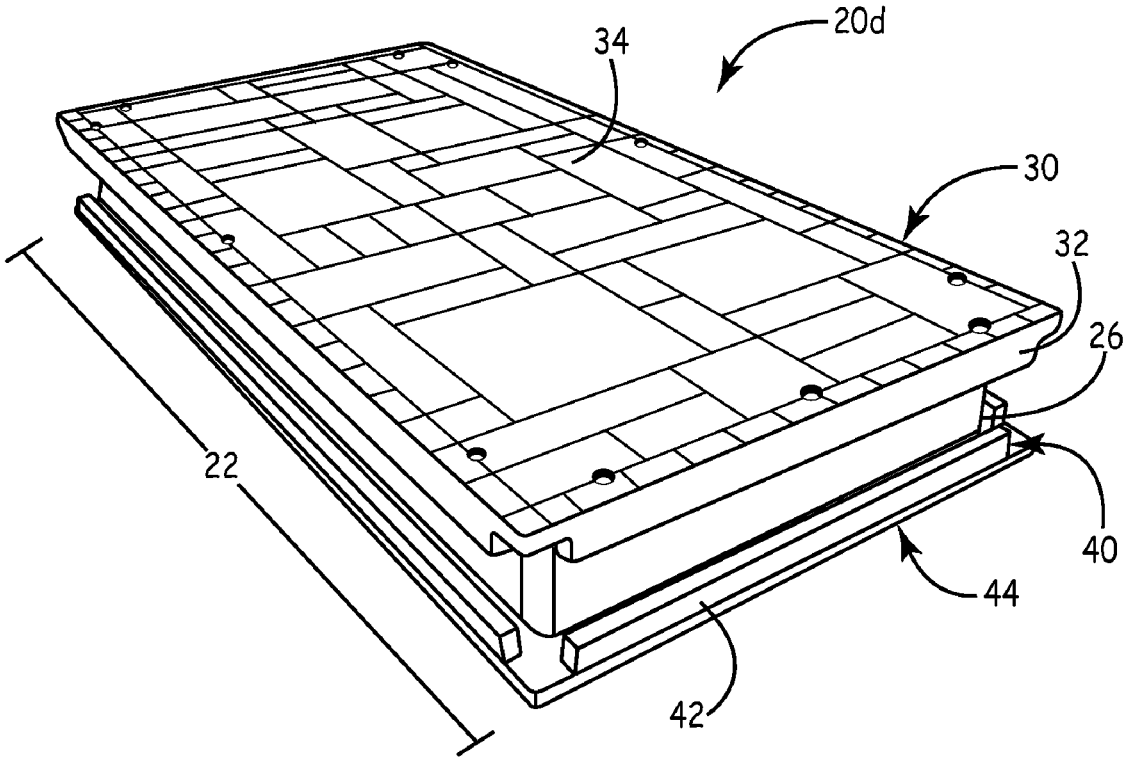
FIG. 5 shows an assembled complete rectangular dock section made in accordance with an implementation of the technology disclosed herein.

FIG. 5 shows an example deck section 20*d* made in accordance with an implementation of the technology disclosed herein. The floating dock section 20*d* typically includes a float 40 with a top panel 30 disposed thereon. In various embodiments, the top surface 34 of the top panel 20*d* remains above the waterline when the deck section 20*d* is placed in water. In at least one embodiment, the top panel 20*d* remains above the waterline when the deck section 20*d* is placed in water. The float 40 generally provides buoyancy to the rest of the deck section 20*d*. In various embodiments the float 40 defines one or more air chambers within it. The air chamber can be configured to contain air, foam, or other materials. As described above in the discussion of FIG. 1, the deck section 20*d* can have a variety of shapes and sizes, and in various embodiments the deck section 20*d* can range from about 10 inches to about 20 inches in thickness. In one embodiment the deck section 20*d* is about 15 inches thick.

The top panel 30 and the float 40 of the dock section 20*d* can be constructed of a molded polyethylene, and be molded such that the top panel 30 and the float 40 mutually engage through a variety of means known in the art. In one configuration, the top panel 30 is bolted to the float 40 through apertures defined by the top panel 30 that substantially align with apertures defined by the float 40. In another configuration, the bottom side of the top panel 30 defines a male or female structure and the float defines a corresponding mating structure by which the top panel 30 and the float 40 are coupled. In yet another configuration, a combination of approaches to couple the top panel 30 and the float 40 can be employed. It will be appreciated by those skilled in the art that the top panel 30 and the float 40 of the dock section 20*d* can be constructed of a variety of other materials and combinations of materials including metals, other plastics, fiberglass, and the like.

As described in the discussion of FIGS. 1-4, above, the dock sections 20*d* (and additional components of the dock system) are configured to removably couple along one or more edges to allow customized construction of a floating dock that has various configurations, depending upon personal needs, requirements, and restrictions in each particular instance where the floating dock system is employed. For example, the length, width, and shape of the floating dock system can be readily changed. Customization can occur when the dock is first installed, after installation, and over time as the dock is expanded and modified.

One or more edges of a dock section are constructed to mutually engage with other dock sections. Mutual engagement of the dock sections can be achieved through a variety of methods and configurations. The dock sections can be configured to bolt together in one embodiment. In another embodiment the dock sections have edge profiles that allow mutual engagement of the dock sections by defining mating surfaces, for example. The dock sections can mutually engage through any means known in the art. In the current embodiment each dock section mutually engages a portion of a connector beam which results in coupling of the dock sections.

Both FIG. 5 and FIG. 6 can be better understood in light of FIG. 7, which depicts a first dock section coupled to a second dock section by a connector beam. The following description is provided in light of FIG. 5, FIG. 6, and FIG. 7.

The top panel 30 and the float 40 of the dock section 20*d* mutually define a slot 26 that is configured to receive a portion of a connector beam 50. A top panel flange 32 extends downward from, and substantially perpendicular to, the top surface 34 of the top panel 30 to define a portion of the slot 26. A float flange 42 extends upward from, and substantially perpendicular to, the bottom surface 44 of the float 40 to define a portion of the slot 26. The slot 26, the top panel flange 32, and the float flange 42 substantially extend the length of the edge 22 of the dock section 20*d* in various embodiments. In various embodiments the slot 26 defined by a dock section 20*d* receives one side of the connector beam 50, and a second dock section 20*e* (depicted in FIG. 7) receives a second side of the connector beam 50.

The connector beam 50 generally has two parallel vertical beams 51 that are joined by a horizontal beam 52 disposed there-between, which defines a top panel channel 55 at the top of the connector beam 50 and a float flange channel 56 at the bottom of the connector beam 50. The top panel channel 55 extends the length of the connector beam 50 and receives the top panel flange 32. The top panel channel 55 of the connector beam 50 accommodates the top panel flange 32 of a first dock section 20*d* and the top panel flange 32*a* of a second dock section 20*e*, which are substantially identical. The float flange channel 56 extends the length of the connector beam 50 and receives the float flange 42. The float flange channel 55 of the connector beam 50 accommodates the float flange 42 of a first dock section 20*d* and the float flange 42*b* of a second dock section 20*e*, which are substantially identical. In a particular embodiment the connector beam 50 is constructed of polyethylene, although it will be appreciated by those skilled in the art that the connector beam 50 can be constructed of a variety of materials including metals, other plastics, fiberglass, and the like.

In a variety of embodiments a secondary coupling mechanism is employed to couple the connector beam 50 to the first dock section 20*d* and second dock section 20*e*. For example, the connector beam 50 and each dock section 20*d* can define various substantially aligned coupling apertures 53 (shown on the connector beam in FIG. 6 and shown on a dock section in FIG. 8) configured to receive one or more screws, bolts, or the like. Coupling apertures 53 can be defined by the top panel flange 32, the float flange 42, and the vertical beams 51 of the connector beam 50.

There are a variety of configurations that the connector beam 50 and the edge 22 of the dock sections 20*d* can have to mutually engage. FIGS. 20A-20G depict various embodiments of a connector beam that are consistent with the technology disclosed herein. Those skilled in the art will appreciate that there are innumerable system configurations that will allow coupling of dock sections 20*d*. Those skilled in the art will also appreciate that there are innumerable connector beam configurations in particular, and accommodating edge 22 configurations of dock sections 20*d*, that will allow coupling of dock sections.

Figure 8:
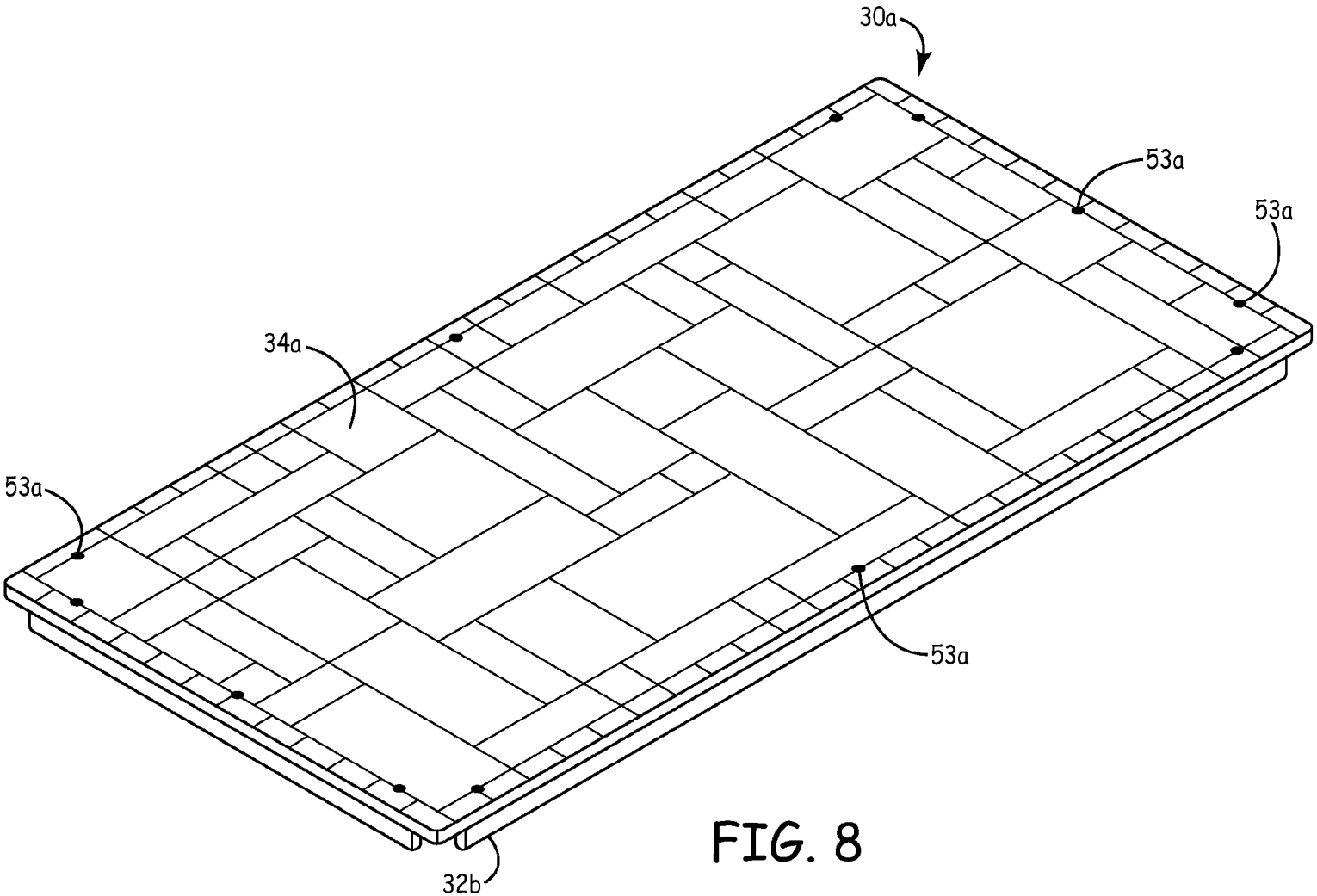
FIG. 8 shows a top perspective view of a top panel of the deck of a dock made in accordance with an implementation of the technology disclosed herein.
Figure 9:
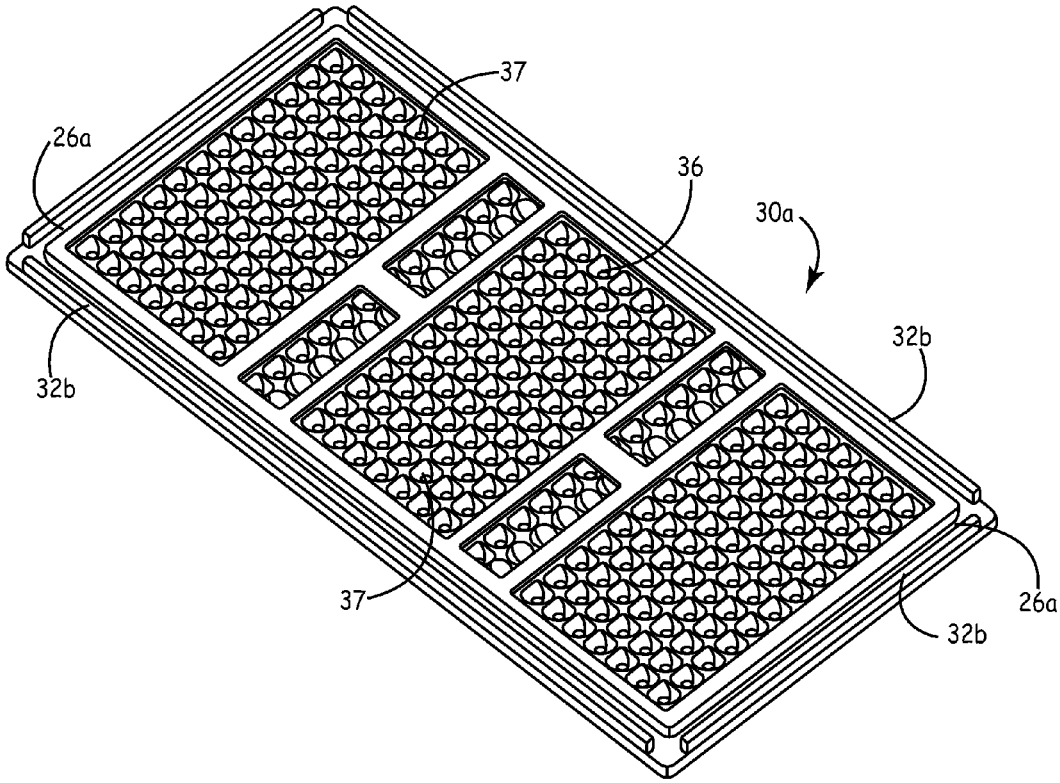
FIG. 9 shows a bottom perspective view of a top panel of the deck a dock made in accordance with an implementation of the technology disclosed herein.

FIG. 8 shows a top perspective view of a top panel of the deck of a dock made in accordance with an implementation of the invention, and FIG. 9 shows a bottom perspective view of a top panel in accordance with an implementation of the invention. The top panel 30*a* has a substantially planar top surface 34*a*. As mentioned above, the top panel 30*a* can define coupling apertures 53*a* by which the top panel 30*a* can be secured to a connector beam, for example. The coupling apertures 53*a* can also be used to couple the top panel 30*a* to accessories such as horizontal bumpers, as described in the description of FIG. 2, above. The top panel 30*a* can have a variety of sizes and configurations, and in one embodiment is 5 inches tall by 40 inches wide by 60 inches long.

The bottom surface 36 of the top panel 30*a* defines a slot 26*a* around substantially around an inner perimeter of the bottom surface 36. A top panel flange 32*b* extends perpendicularly from the plane defined by the top surface 34*a* and defines an outer boundary of the slot 26 along a partial length of each side of the top panel. The top panel flange 32*b* extends partially around the perimeter of the bottom surface 36. Molded-in inserts on the bottom surface 36 of the top panel 30*a* can allow the top panel 30*a* and the float to be bolted together.

The top panel 30*a* can be constructed of a variety of materials, and in one embodiment rectangular sections and triangular sections are at least partially constructed of polyethylene. It will be appreciated by those skilled in the art that the top panel can be constructed of a variety of materials including metals, other plastics, fiberglass, and the like. The top panel 30*a* can have a variety of configurations. In one embodiment the top panel 30*a* is corrugated. In another embodiment the top panel 30*a* defines a plurality of nodules 37 across the bottom surface 36 of the top panel 30*a*.

FIG. 10*a* shows a top perspective view of a float of a dock made in accordance with an implementation of the invention. FIG. 11*a* shows a bottom perspective view of a float of a dock made in accordance with an implementation of the invention. The float 40*a* is a molded plastic in a variety of embodiments and is an at least partially hollow housing that defines a chamber. The chamber contains air, but can also have foam disposed therein.

The top surface 46 of the float 40*a* defines thru-holes 43 for mounting a top panel thereto. The thru-holes 43 can be implemented in conjunction with screws, bolts, and the like, to couple with a top panel. The top surface 46 can define one or more center channels 45. Center channels 45 can provide pathways for hoses, wiring, and the like, and are not necessarily defined central to the top surface 46 of the top panel. The top surface 46 of the float 40*a* defines a slot 26*b* substantially around an inner perimeter of the top surface 46. A float flange 42*b* extends perpendicularly from a plane defined by the float 40*a* and defines an outer boundary of the slot 26*b* along a partial length of each side of the float 40*a*. The float flange 42*b* extends partially around the perimeter of the top surface 46.

The bottom surface 44*a* of the float 40*a* is generally configured to make contact with the surface of the water upon installation. Thru-holes 43 that are visible from the top surface 46 of the float 40*a* extend through the float 40*a*. Cut-outs 47 are defined by the float 40*a* on the bottom surface 44*a*. The cut-outs 47 can, in one or more embodiments, provide suction to the surface of the water and/or aid in flotation of the dock section on water. While the current embodiment depicts twelve cut-outs 47, more or less cut-outs 47 can be implemented.

FIG. 10*b* shows a top perspective view of a float of a dock made in accordance with an alternative implementation of the invention. FIG. 11*b* shows a bottom perspective view of a float of a dock made in accordance with an alternative implementation of the invention. The float 40*b* can have a variety of shapes and sizes, and in the current embodiment its dimensions are 40 inches wide by 60 inches in length by 11 inches tall.

Similar to the embodiment depicted above, the top surface 46*a* of the float 40*b* defines thru-holes 43*a* for mounting a top panel thereto. The top surface defines two center channels 45*a* and a slot 26*c* substantially around an inner perimeter of the top surface 46*a*. A float flange 42*c* extends perpendicularly from a plane defined by the float 40*b* and defines an outer boundary of the slot 26*c* along a partial length of each side of the float 40*b*. The float flange 42*c* extends partially around the perimeter of the top surface 46*a*.

Thru-holes 43*a* that are visible from the top surface 46*a* of the float 40*b* extend through the float 40*b* and are also visible on the bottom surface 44*b* of the float 40*b*. Cut-outs 47*a* are defined by the float 40*b* on the bottom surface 44*b*. The current embodiment incorporates four cut-outs 47*a* into the structure of the bottom surface 44*b* of the float 40*b*.

Anchoring points 48*a* are defined adjacent to the perimeter of the bottom surface 44*b* of the float 40*b* are and generally configured to receive ropes associated with anchors or tie-downs. Anchoring points 48 are generally defined so as to be symmetric relative to the float 40*b*.

As described above in the discussion of FIG. 5, the edges of the dock sections can couple to other dock sections through the use of a connector beam, for example. In some implementations, other components can be incorporated into the systems that are configured to mate with the edges of the dock sections. Such components can be referred to as "accessories" for purposes of this application and each can define one or more beams that collectively engage the slot defined by the dock section, for example. FIG. 12 depicts the post adapter accessory as depicted and described in the description of FIG. 2.

The post accessory 120*a* is an example accessory that has an attachment structure 121 and a functional structure 126, where the attachment structure 121 is configured to couple to an edge of a dock section and the functional structure 126 is configured to provide functionality for the post accessory 120*a*. As described above in the discussion of FIG. 2, the post accessory 120*a* is configured to receive a post. A post received by the post accessory 120*a* can be used, for example, to hold the floating dock system in place, especially in larger bodies of water or places with a current.

The attachment structure 121 defines a structure that couples to the edge structure of a dock section and can have a variety of configurations in various embodiments. In the current embodiment, the attachment structure 121 has a horizontal beam 123 that is coupled to the functional structure 126 and a vertical beam 122 that is coupled perpendicularly to the horizontal beam 123.

A top panel channel 124 is defined by the horizontal beam 123 along the bottom of the top panel channel 124, the functional structure 126 along a first side of the top panel channel 124 and the vertical beam 122 along a second side of the top panel channel 124. A float flange channel 125 is defined by the horizontal beam 123 along the top of the float flange channel 125, the functional structure 126 along a first side of the float flange channel 125, and the vertical beam 122 along a second side of the float flange channel 125. Referring jointly now to the current FIG. 12 and previously discussed FIG. 5, the top panel channel 124 is configured to receive the top panel flange 32 of a first dock section 20*d*. The float flange channel 125 is configured to receive the float flange 56 of the first dock section 20*d*.

The functional structure of an accessory can vary with the purpose and design of the particular accessory. The functional structure 126 of the post accessory 120*a*, for example, is configured to receive a post that can be used for a variety of purposes including, as mentioned above, preventing translation of the dock relative to a shoreline. The functional structure 126 can have a variety of shapes and sizes, and in the current embodiment is constructed of material in the form of a rounded triangular prism. The functional structure 126 defines a post opening 127 that is configured to receive a post. The post opening 127 is substantially cylindrical. In various embodiments the post opening 127 has an axis that is configured to be substantially perpendicular to the top surface of the dock section when coupled by the dock section.

In the current embodiment the post opening 127 is particularly defined by a post adapter 129 that is part of the functional structure 126. The post adapter 129 can define post openings 127 of a variety of shapes and sizes to accommodate posts and other components having a corresponding shape and size. In the current embodiment the post adapter 129 is interchangeable with post adapters defining alternate post openings. The post adapter opening 128 defined by a portion of the functional structure 126 of the post accessory 120*a* can be cylindrical to accommodate a post adapter that is substantially cylindrical. Differently-shaped openings can also be defined to correspond to post adapters having different shapes. An example post adapter is depicted in more detail in FIG. 21 below. Additional example accessories are depicted in additional FIGS. 15-35, below.

As described above, dock sections can have a variety of sizes, shapes, and configurations. FIG. 13 shows an assembled complete square dock section made in accordance with an implementation of the invention. FIG. 14 shows an assembled complete triangular dock section made in accordance with an implementation of the invention. As described in the discussion of FIG. 1, above, dock sections can have a variety of shapes and sizes to be consistent with the technology disclosed in this application.

The square dock section 60 has a top panel 30*b* with a top surface 34*b* that is substantially square in shape. The square dock section 60 also has a float 40*c* that is substantially square in shape. Likewise, the triangle dock section 70*a* has a top panel 30*c* with a top surface 34*c* that is substantially triangular in shape. The triangle dock section 70*a* also has a float 40*d* that is substantially triangular in shape. The square dock section 60 and the triangular dock section 70*a* can be constructed similarly to the dock sections discussed above in the discussions of FIGS. 5 and 7-11*b*.

The port as described in FIG. 1 can have a variety of configurations and incorporate a variety of accessories. FIG. 15 shows an embodiment of a port made in accordance with an implementation of the technology disclosed herein. FIG. 16 shows another embodiment of a port made in accordance with an implementation of the technology disclosed herein. FIG. 17 shows the underside of a port made in accordance with an implementation of the technology disclosed herein.

The port 80*c* can be constructed of a variety of materials and is described generally above in the discussion of FIG. 1. A water craft indentation 81 is configured to receive a water craft. In various embodiments the water craft can be a personal water craft. The port 80*c* is configured to engage the edge structure of one or more dock sections. Referring now to FIG. 5 in addition to the current FIGS. 15-17, at least one edge of the port 80*c* defines a portion of an attachment structure that is configured to couple the port 80*c* to a dock section. The attachment structure 112*a* can be as described in the description of FIG. 12, above, or, as in the current embodiment, the attachment structure can define a portion of an attachment structure having a float flange 32*c* that partially defines a float flange channel 26*c* to couple a float flange to the port 80*c*.

Standard rollers 82 can be rotationally disposed in the surface of the water craft indentation 81 such that a water craft at least partially engages the standard rollers 82 upon contacting the surface of the water craft indentation 81. An example standard roller 82 is depicted in more detail in FIG. 30, and can be referenced with this description for more clarity. The standard rollers 82 rotate about an axis 82*a* that is coupled to the port 80*c*. The standard rollers 82 can be received openings defined by the port within the water craft indentation 81. The standard rollers can be constructed of a variety of materials known in the art, and in various configurations a roller 82 and its axis 82*a* is a single component that is a molded plastic. The standard rollers 82 generally are symmetrical around a central axis and may define ridges, bumps, and the like on its outer surface that can increase frictional forces when the standard roller is engaging a water craft. In the current embodiment the radius of each standard roller 82 generally increases from the ends of the standard roller 82 towards the central portion of the standard roller 82.

Front rollers 89 can be incorporated in various openings defined by the port 80*c*, as well. An example front roller 89 is depicted in more detail in FIG. 31, and can be referenced with this description for more clarity. Front rollers 89 can be similar to standard rollers 82 and, in one embodiment, the radius of the front roller 89 decreased towards an intermediate point along the length of the front roller 89. In the current embodiment the radius of the front roller 89 decreases from each end of the front roller 89 towards a point substantially in the center of the length of the front roller 89. Such a configuration can improve accommodating the bottom surface personal water craft when sliding it on and off the port 80*c* surface. Front rollers 89 can be used on a boat ramp 86 defined by the port 80*c* towards the front entry of the water craft indentation 81. The front rollers 89 also have a central axis 89*a* about which they rotate. Likewise, the front rollers 89 can be constructed of a variety of materials known in the art, and in various configurations a front roller 89 and its axis 89*a* is a single component that is a molded plastic.

In various embodiments an entrance slide 88 can be incorporated towards the front entry of the water craft indentation 81, and is depicted in FIG. 16. An example entrance slide 88 is also depicted in FIG. 28, and can be referenced with this description for more clarity. The entrance slide 88 can be configured to sit below the water further below the entry surface of the port 80*c* and accommodate the shape of a water craft. The entrance slide 88 can be constructed of a variety of materials known in the art, and in various configurations the entrance slide 88 is a single component that is a molded plastic. The entrance slide 88 can couple to the dock through a variety of means known in the art including bolts, screws, a mating structure that mates with a corresponding mating structure on the port 80*c*, and the like. One of ordinary skill in the art will recognize that various combinations of approaches to couple the entrance slide 88 to the port 80*c* can be used. In the current embodiment the entrance slide 88 couples to the port via an opening defined by the port 80*c* that is alternatively configured to receive a front roller 82*c*.

In various embodiments roller plugs 83 can be used instead of standard rollers 82 or front rollers 82*c*, as depicted in FIG. 16. An example roller plug 83 is depicted in more detail in FIG. 32, and can be referenced with this description for more clarity. Roller plugs 83 are configured to define a surface that covers openings in the port 80*c* that alternatively receive the standard rollers 82 or front rollers 82*c*. Roller plugs 83 can be constructed of a variety of materials known in the art, and in various configurations the roller plugs 83 are a single component that is a molded plastic.

A bow stop 87 can be received by the port 80*c* that is configured to prevent movement of a water craft beyond a certain point on the port 80*c* and is depicted in FIG. 16. An example bow stop 87 is depicted in more detail in FIG. 33, and can be referenced with this description for more clarity. The bow stop 87 can have a variety of configurations and be constructed of a variety of materials and be consistent with the technology disclosed herein. In the current embodiment the bow stop 87 defines a bow indentation 87*a* that is configured to partially receive the front surface of the bow of a water craft. The bow stop 87 can be constructed of a variety of materials known in the art, and in various configurations the bow stop 87 is a single component that is a molded plastic. The bow stop 87 can couple to the dock through a variety of means known in the art including bolts, screws, a mating structure that mates with a corresponding mating structure on the port 80*c*, and the like. One of ordinary skill in the art will recognize that various combinations of approaches to couple the bow stop 87 to the port 80*c* can be used.

The bottom surface 84 of the port 80*c* defines pontoons 85 that are configured to aid in port flotation and stability. Pontoons 85 incorporated into the structure of the port 80*c* in a variety of embodiments are molded with the rest of the port 80*c*. The bottom surface 84 of the port 80*c* can define multiple insets 84*a* that can have a variety of purposes including providing some level of rigidity and improving the structural integrity of the port 80*c*.

At least a portion of the edge of the port 80*c* defines an edge structure similar to that of a top panel flange of a dock section as depicted and described in FIG. 9, in that a slot 26*d* is defined around a portion of an inner perimeter of the bottom surface 84 of the port 80*c*. A flanges 32*c* extends perpendicularly from a plane defined by the bottom surface 84 of the port 80*s* and define an outer boundary of portions of the slot 26*d*. A C-clamp, such as the one depicted in FIGS. 18*a* and 18*b*, described below, can be coupled to a portion of the bottom surface 84 of the port 80*c* whereby various accessories can be coupled to the port 80*c* that are already configured to couple to an edge of a dock section. After coupling a C-clamp to the port 80*c*, at least a portion of the edge of the port 80*c* can define a similar edge structure to that of a dock section as depicted and described in reference to FIG. 5. Such an edge structure allows the port 80*c* to receive an accessory having a top panel channel and a float channel as described in FIG. 12, above, and is described in more detail below.

FIG. 18 depicts a C-clamp in accordance with an implementation of the technology disclosed herein, and FIG. 25 described below depicts the c-clamp of FIG. 18 in an example implementation in accordance with the technology disclosed herein. A top surface 46*b* of the C-clamp 40*e* can be configured to mate with a bottom surface of a dock component such as a port described above. The top surface 46*b* can define one or more apertures 43*b* that are configured to receive coupling components such as bolts, screws, and the like, where the coupling components also receive a portion of the bottom surface of the port. The C-clamp 40*e* can be bolted, for example, to the port through apertures 43*b* defined by the C-clamp 40*e* that substantially align with apertures defined by the port. In another configuration, a male or female structure defined by the C-clamp 40*e* is coupled to a portion of the port that defines a corresponding mating structure. In yet another configuration, a combination of approaches to couple the C-clamp 40*e* and the port can be employed.

The C-clamp 40*e* defines a portion of a slot 26*e* that is configured to receive a portion of a connector beam or a portion of an attachment structure as described above in the description of FIG. 12. When the C-clamp 40*e* is coupled to a component such as a port (that will now be referred to as a "port" for simplicity) the C-clamp and the port substantially define the slot 26*e* that is configured to receive a connector beam or a portion of an attachment structure. The C-clamp 40*e* has a clamp flange 42*d* that is the functional equivalent of the float flange described in detail in the description of FIG. 5, FIG. 6, and FIG. 7. The clamp flange 42*d* extends upward from, and substantially perpendicular to, the bottom surface of the portion of the slot 26*e* defined by the C-clamp 40*e*.

A portion of the slot 26*e* defined by the port 80*d* receives one side of an attachment structure of an accessory, and a portion of the slot 26*e* defined by the C-clamp receives a second side of an attachment structure. The slot 26*e* defined by the port 80*d* and the C-clamp 40*e* can also receive a side of a connector beam to be coupled to a dock section, much like the way two dock sections can be coupled as explained in the description of FIG. 7, above. The accessory is a hinge that will be described in more detail in the description of FIG. 26, below.

FIG. 19 shows an accessory that is a vertical bumper in accordance with an implementation of the technology disclosed herein. The vertical bumper 111 is an example accessory that has an attachment structure 112 and a functional structure 113, where the attachment structure 112 is configured to couple to an edge of a dock section (or a port as described above) and the functional structure 113 is configured to provide functionality for the vertical bumper 111. The attachment structure 112 is substantially similar to the attachment structure described in the discussion of FIG. 12, above.

The functional structure 113 of the vertical bumper 111 is configured for holding off a boat at the end of the dock system. The vertical bumpers 111 are configured to couple to exposed edges of rectangular sections and/or a port. The vertical bumpers 111 can have a variety of shapes and sizes, and generally create a space between the exposed edges of the floating dock system and an adjacent watercraft. The vertical bumpers 111 can be constructed of a variety of materials including plastics, foams, fiberglass, and so on. In one embodiment the vertical bumpers 111 are poly-vinyl. The functional structure 113 of the vertical bumper can have a variety of shapes and sizes, and in the current embodiment is broadly resembles a half cylinder where the cylinder axis 114 is vertically oriented with rounded edges. Elongated bulges 115 are defined along the length of the functional structure 113 of the vertical bumper.

Now the discussion is turned back to the connector beams. As described above in the discussion of FIG. 7, the connector beam can have a variety of configurations that are consistent with the technology disclosed herein. FIGS. 20A-20G, which are now described, depict some example alternative embodiments of such connector beams and corresponding dock sections:

FIG. 20A shows an alternative embodiment of a connector beam coupling a first dock section and a second dock section in accordance with an implementation of the technology disclosed herein. In this embodiment the connector beam 400*a* has a cross-section that is a cross, and the first dock section 200*a* and second dock section 300*a* define a first portion of a slot 210*a* and second portion of a slot 310*a*, respectively, that is configured to accommodate the connector beam 400*a* such that the first dock section 200*a* and the second dock section 300*a* are coupled.

FIG. 20B shows another alternative embodiment of a connector beam coupling a first dock section and a second dock section in accordance with an implementation of the technology disclosed herein. In this embodiment the connector beam 400*b* has a cross-section that is an "H" with a thinner horizontal beam than that connector beam depicted in FIG. 7. The first dock section 200*b* and second dock section 300*b* define a first portion of a slot 210*b* and second portion of a slot 310*b*, respectively, that is configured to accommodate the connector beam 400*b* such that the first dock section 200*b* and the second dock section 300*b* are coupled.

FIG. 20C shows another alternative embodiment of a connector beam coupling a first dock section and a second dock section in accordance with an implementation of the technology disclosed herein. In this embodiment there is a top connector beam 400*c* and a bottom connector beam 410*c*. The top connector beam 400*c* and the bottom connector beam 410*c* have cross-sections that are a "U" and inverted "U", respectively. The first dock section 200*c* defines a first top slot 210*c* and first bottom slot 220*c*, where the first top slot 210*c* is configured to accommodate a portion of the top connector beam 210*c* and the first bottom slot 220*c* is configured to accommodate a portion of the bottom connector beam 220*c*. The second dock section 300*c* defines a second top slot 310*c* and second bottom slot 320*c*, where the second top slot 310*c* is configured to accommodate a portion of the top connector beam 210*c* and the second bottom slot 320*c* is configured to accommodate a portion of the bottom connector beam 220*c*. The first dock section 200*c* and the second dock section 300*c* are configured to accommodate the top connector beam 400*c* and the bottom connector beam 410*c* such that the first dock section 200*c* and the second dock section 300*c* are coupled.

FIG. 20D shows another alternative embodiment of a connector beam coupling a first dock section and a second dock section in accordance with an implementation of the technology disclosed herein. In this embodiment there is a top connector beam 400*d* and a bottom connector beam 410*d*, as well. But in this configuration the top connector beam 400*d* and the bottom connector beam 410*d* have cross-sections that are "H"-shaped. The first dock section 200*d* defines a first top slot 210*d* and first bottom slot 220*d*, where the first top slot 210*d* is configured to accommodate a portion of the top connector beam 210*d* and the first bottom slot 220*d* is configured to accommodate a portion of the bottom connector beam 220*d*. The second dock section 300*d* defines a second top slot 310*d* and second bottom slot 320*d*, where the second top slot 310*d* is configured to accommodate a portion of the top connector beam 210*d* and the second bottom slot 320*d* is configured to accommodate a portion of the bottom connector beam 220*d*. The first dock section 200*d* and the second dock section 300*d* are configured to accommodate the top connector beam 400*d* and the bottom connector beam 410*d* such that the first dock section 200*d* and the second dock section 300*d* are coupled.

FIG. 20E shows another alternative embodiment of a connector beam coupling a first dock section and a second dock section in accordance with an implementation of the technology disclosed herein. In this embodiment the connector beam 400*e* has a cross-section that is similar to the U-beams that are the top connector beam and bottom connector beam of FIG. 20C, except also including a vertical portion of the connector beam that joins the top U-beam to the bottom, inverted U-beam. The first dock section 200*e* and second dock section 300*e* define a first portion of a slot 210*e* and second portion of a slot 310*e*, respectively, that is configured to accommodate the connector beam 400*e* such that the first dock section 200*e* and the second dock section 300*e* are coupled.

FIG. 20F shows another alternative embodiment of a connector beam coupling a first dock section and a second dock section in accordance with an implementation of the technology disclosed herein. In this embodiment the connector beam 400*f* has a cross-section that is similar to a "figure-8". The first dock section 200*f* and second dock section 300*f* define a first portion of a slot 210*f* and second portion of a slot 310*f*, respectively, that is configured to accommodate the connector beam 400*f* such that the first dock section 200*f* and the second dock section 300*f* are coupled. In this embodiment the connector beam 400*f* is positioned below the top panel and only directly engages the bottom panel.

FIG. 20G, however, shows a connector beam substantially similar to the connect beam depicted in FIG. 20F, except that a first portion of a slot 210*g* defined by a first dock section 200*g* and a second portion of a slot 310*g* defined by a second dock section 300*g*, which are configured to accommodate the connector beam 400*g*, are positioned to partially engage the top panels of the first dock section 200*g* and second dock section 300*g* as well as the bottom panels of the first dock section 200*g* and the second dock section 300*g*. Those skilled in the art will appreciate that the connector beam 400*g* can couple the first dock section 200*g* and the second dock section 300*g* in a variety of locations relative to the top and bottom panels.

FIG. 21 is an example post adapter in accordance with an implementation of the technology disclosed herein. The post adapter 140 has a base 141 that is configured to be received by a post accessory, as described in FIG. 12, or, in some embodiments, a dock component or port component. The base 141, in the current embodiment, is a cylinder defining a central opening 143.

The base 141 is configured to be received by a corresponding post attachment opening in a post attachment depicted in FIG. 12. The base 141 can couple to the post attachment in a variety of ways known in the art. In the current embodiment the outer surface of the base 141 frictionally engages the outer surface of the post attachment opening. The post adapter opening defined by a portion of the post attachment as described in FIG. 12 can be cylindrical to accommodate a post adapter base 141 that is substantially cylindrical. Differently-shaped post adapter openings can also be defined to correspond to post adapters having different shapes.

A flange 142 extends substantially along a surface perpendicular to the central axis of the base 141. In the current embodiment the bottom surface of the flange 142 is configured to contact a surface of a post attachment to which it is coupled. The flange 142 defines apertures 144 that are configured to align with apertures on a post attachment and receive screws, bolts, or the like.

The central opening 143 is cylindrical in shape and is configured to accommodate a post. Post adapters 140 defining a variety of structures and/or openings can be interchangeably received by a post adapter opening defined by a post attachment as described in FIG. 12. For purposes of this application, the post adapter 140 received by a post attachment is part of the functional structure of the post attachment. The post adapter 140 can have a variety of shapes and sizes to accommodate posts and other components having corresponding shapes and sizes. In the current embodiment the post adapter 140 is interchangeable with post adapters defining alternatively-sized or alternatively-shaped post openings 143.

FIG. 22 is another example accessory that is a hinge in accordance with an implementation of the technology disclosed herein. The hinge 130 is an example accessory that has an attachment structure 131 and a functional structure 132, where the attachment structure 131 is configured to couple to an edge of a dock section (or a port as described above) and the functional structure 132 is configured to provide functionality for the hinge 130. The hinge 130 can be used to couple various components and accessories to a dock section or port in a pivotable manner. In one embodiment, a ramp can be coupled to a dock section via two or more hinges 130. The attachment structure 131 is substantially similar to the attachment structure described in the discussion of FIG. 12, above.

The functional structure 132 of the hinge 130 is configured for pivotably coupling a component. The functional structure 132 consists of a substantially cylindrical body 133 defining a hinge opening 134, where the cylindrical body 133 is at least partially coupled to the attachment structure 131. The hinge opening 134 is substantially cylindrical in shape and has a central axis 136 that is substantially parallel with the top surface of a dock section when the hinge 130 is installed on the dock section. The hinge opening 134 is configured to substantially accommodate a pivot cylinder of a component such as a ramp to create a pivotable connection. In another embodiment the hinge opening 134 is configured to substantially accommodate a pivot cylinder of a component such as a port. The hinges 130 can be constructed of a variety of materials including plastics, foams, fiberglass, and so on.

In some embodiments the hinge can define an attachment structure that is configured to couple to surfaces and components outside of the system such as wood or aluminum docks. The hinge 130*a* depicted in FIG. 23 has an attachment structure 131*a* defining multiple coupling apertures 135 that are configured to receive screws, bolts, or the like, to couple the hinge 130*a* to another structure.

FIGS. 24, 26, and 29, described below, depict various components that can be coupled to one or more hinges consistent with the technology disclosed herein.

FIG. 24 is an example component that can be coupled to a hinge in accordance with an implementation of the technology disclosed herein. A linkage arm 150 defines two respective hinge cylinders 152 that are each configured to be received by hinge opening of a hinge as described in FIG. 22 and FIG. 23. The linkage arm also has a linkage arm body 151 that is configured to accommodate the cylinder hinge of the functional body of the hinge such that the linkage arm body 151 can pivot about each hinge cylinder 152.

FIG. 25 is an example implementation of the component of FIG. 24 in accordance with an implementation of the technology disclosed herein. A C-clamp 40*f* as described in FIG. 18 is coupled to a port 80*d* such that the attachment structure 131*b* of a first hinge 130*b* is received by a slot defined by the port 80*d* and the C-clamp 40*f*. A hinge opening 134*b* of the functional structure 132*b* of the first hinge 130*b* received a hinge cylinder 152 of the linkage arm body 151, and the hinge opening 131 of the functional structure 132*c* of a second hinge 130*c* received a hinge cylinder 152 of the linkage arm body 151 whereby the linkage arm is pivotably connected about each hinge cylinder 152. The attachment structure 131*c* of the second hinge 130*c* is configured to be coupled to a variety of components such as a wooden dock.

FIG. 26 is another example component that can be coupled to a hinge in accordance with an implementation of the technology disclosed herein. A linkage deck 160 defines four respective hinge cylinders 162 that are each configured to be received by hinge opening of a hinge as described in FIG. 22 and FIG. 23. The linkage deck body 161 is configured to accommodate the cylinder body of the functional body of the hinge such that the linkage deck 160 can pivot about each hinge cylinder 162. The linkage deck 160 is similar to the linkage arm described in the discussion of FIGS. 24 and 25 above, except that the linkage deck 160 accommodates four hinges instead of two, and the linkage deck body 161 extends across the width of the port to which it is coupled.

FIG. 27 is an example implementation of the component depicted in FIG. 26 according to an implementation of the technology disclosed herein. A C-clamp 40*g* is coupled to a port 80*e* such that the attachment structure 131*d* of a first hinge 130*d* is received by a slot defined by the port 80*e* and the C-clamp 40*g*. A hinge opening 134*d* of the functional structure 132*d* of the first hinge 130*d* received a hinge cylinder 162 of the linkage arm body 151, and the hinge opening 134*e* of the functional structure 132*e* of a second hinge 130*e* received a hinge cylinder 162 of the linkage arm body 151 whereby the linkage arm is pivotably connected about an axis through each hinge cylinder 162. The attachment structure 131*e* of the second hinge 130*e* is configured to be coupled to a variety of components such as a wooden dock.

FIG. 28 is an example entrance slide in accordance with an implementation of the technology disclosed herein. In various embodiments an entrance slide 88 can be incorporated towards the front entry of the water craft indentation 81, as depicted in FIG. 16 and described in the explanation associated therewith.

FIG. 29 depicts another example component to be coupled to a hinge in accordance with an implementation of the technology disclosed herein. A ramp 170 defines two respective hinge cylinders 172 on one end that are each configured to be received by hinge opening of a hinge as described in FIG. 22 and FIG. 23. An attachment structure 171 of the ramp is configured to accommodate the cylinder body of the functional body of the hinge such that the ramp 170 can pivot about an axis defined by each hinge cylinder 172.

As described in the discussion of FIG. 1, above, the ramp 170 is generally configured to allow a vehicle to approach the water on a dock system consistent with the technology disclosed herein. The ramp 170 is also configured to be incorporated in other systems as well. The ramp 170 can have an inclined surface 173 starting lowest at an end opposite the hinge cylinders 172, and inclining towards the end having the hinge cylinders 172. The height of the end having the hinge cylinders 172 can vary. The ramp 170 can be employed for a variety of other reasons as well, depending upon personal needs, requirements, and restrictions in each particular instance where the dock is employed.

FIG. 34 is an example horizontal bumper in accordance with an implementation of the technology disclosed herein and FIG. 35 is another example horizontal bumper in accordance with an implementation of the technology disclosed herein.

Component Construction

A variety of methods known and unknown in the art can be used to construct components described herein. In one embodiment components are constructed of a polyethylene skin-foam. Polyethylene is added to a mold, where the mold is of the component to be constructed. The mold is then placed in an oven until the polyethylene starts to stick and/or melt to the inside of the mold. A mixture of polyethylene and a blowing agent is placed in a drop box in communication with the oven, where the drop box is configured to release the polyethylene and the blowing agent into the mold (and, therefore, the oven) at a particular time. The drop box can be automatic or user-operated.

When the polyethylene is melted and substantially equally distributed throughout the surface of the mold, which can be accomplished through rotating the mold, for example, although other approaches can be used. The drop box of polyethylene and blowing agent mixture is opened to release the mixture into the mold. The oven is heated once again to cause the polyethylene to melt and distribute itself throughout the mold. The heat of the oven triggers the blowing agent to produce polyethylene foam.

The above-described method can be used in manufacturing of a wide variety of products including, but not limited to, the following products: boats, decks, ports, building panels, various accessories as described herein, doors, and docks.

In constructing a dock section in accordance with the technology disclosed herein, it can be advantageous to implement methods of construction that allows for the creation of minimum molds while still providing consumers with a variety of dock size options. FIGS. 36A-37B demonstrate two example dock section sizes that both incorporate multiple floats where each float has a substantially similar size and shape as the other floats.

FIG. 36A shows an exploded view of a complete rectangular dock section, FIG. 36B shows a top perspective view of the assembled complete rectangular dock section, and FIG. 36C shows a bottom perspective view of the assembled complete rectangular dock section. The dock section 20*f* has a top panel 30*d* that is coupled to the top of three substantially identical floats 40*h*. The top panel 30*d* has a length $l_1$ that is approximately equal to the combined widths $w_1$ of the three floats 40*h*. The width $w_2$ of the top panel 30*d* is approximately equal to the length $l_2$ of one of the floats 40*h*.

FIG. 37A shows a top perspective view of another embodiment of an assembled complete rectangular dock section made in accordance with an implementation of the technology disclosed herein, and FIG. 37B shows a bottom perspective view of the rectangular dock section 20*g*, where the dock section has a top panel 30*e* coupled on top of two substantially identical floats 40*i*. In this configuration, the length $l_3$ of the top panel 30*e* is approximately equal to the combined length $l_4$ of each of two floats 40*i*, and the width $w_3$ of the top panel 30*e* is approximately equal to the width $w_4$ of one of the two floats 40*i*.

Other sizes of dock sections can be constructed combining multiple floats having one or more particular sizes to a top panel, where the length and width of the top panel is approximately equal to a length and width of a particular combination and orientation of floats.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

We claim:

1. A floating dock system, the floating dock system comprising:

at least two dock sections, each of said dock sections comprising an upper panel and a lower panel, the upper and lower panels secured to one another, the upper panel comprising a substantially planar body having a top, a bottom and at least three edges, the top of the upper panel having an outside perimeter greater than the outside perimeter of bottom of the upper panel such that the upper panel has a lip extending around the perimeter of its top;

the lower panel comprising a substantially planar body having a top, a bottom, and at least three edges, the top of the lower panel having an outside perimeter less than the outside perimeter of the bottom of the lower panel such that the lower panel has a lip extending around the perimeter of its bottom;

said dock sections comprising substantially horizontal slots along at least one edge, said slots comprising a top edge formed by the lip extending around the perimeter of the upper panel; a bottom edge formed by the lip extending around the perimeter of the lower panel, and an intermediate area between the edges, the intermediate area configured such that the edge of the bottom dock panel forms more of the intermediate portion of the slot than the edge of the top panel; and at least one buoyant coupling member configured to engage the horizontal slot in at least two dock sections, the coupling member having a face that makes greater contact with the bottom panel than with the top panel;

a plurality of holes in the perimeter of the top panel configured to allow insertion of a fastener through the holes into the coupling member so as to retain the coupling member in the slot; the plurality of holes extending from the upper surface of the top panel through the top panel and into the buoyant coupling member;

whereby the at least two dock sections are retained together by the at least one coupling member inserted into the slot of each dock section, the coupling member further retained by a fastener inserted through the holes in the top panel of each dock section and into the coupling member.

2. The floating dock system of claim 1, wherein the dock sections are configured to float on the water.

3. The floating dock system of claim 1, wherein the dock sections are roto-molded.

4. The floating dock system of claim 1, wherein the coupling member extends along an edge of the dock sections.

5. A section for a floating dock, the section comprising:

a top surface and at least a first side; a second side, and a third side; the dock section comprising an upper panel and a lower panel, the upper and lower panels secured to one another, the upper section comprising a substantially planar body having a top, a bottom and at least three edges;

the upper panel comprising a substantially planar body having a top, a bottom and at least three edges, the top of the upper panel having an outside perimeter greater than the outside perimeter of bottom of the upper panel such that the upper panel has a lip extending around the perimeter of its top;

the lower panel comprising a substantially planar body having a top, a bottom, and at least three edges, the top of the lower panel having an outside perimeter less than the outside perimeter of the bottom of the lower panel such that the lower panel has a lip extending around the perimeter of its bottom;

said dock sections comprising substantially horizontal slots along at least one edge, said slots comprising a top edge formed by the lip extending around the perimeter of the upper panel; a bottom edge formed by the lip extending around the perimeter of the lower panel, and an intermediate area between the edges, the intermediate area configured such that the edge of the bottom dock panel forms more of the intermediate portion of the slot than the edge of the top panel; and a opening in the edge of the first side, said opening in communication with at least the second side or the third side;

wherein the opening in the edge of the first side is configured for receipt of a buoyant coupling member.

6. The section for a floating dock of claim 5, wherein the dock section is configured to float on water.

7. The section for a floating dock of claim 5, wherein the dock section is roto-molded.

8. The section for a floating dock of claim 5, wherein the coupling member extends along an edge of the dock sections.

9. A method of attaching two floating sections of dock, the method comprising:

providing a first dock section and a second dock section, each dock section configured to float on the surface of water and each section having channels in at list one side of the dock and each section comprising:

a top surface and at least a first side; a second side, and a third side; the dock section comprising an upper panel and a lower panel, the upper and lower sections secured to one another, the upper section comprising a substantially planar body having a top, a bottom and at least three edges;

the top of the upper section having an outside perimeter greater than the outside perimeter of bottom of the upper section such that the upper section has a lip extending around the perimeter of its top;

the lower section comprising a substantially planar body having a top, a bottom, and at least three edges, the top of the bottom section having an outside perimeter less than the outside perimeter of the bottom section such that the lower section has a lip extending around the perimeter of its bottom;

and said dock sections comprising substantially horizontal slots along at least one edge, said slots comprising a top edge formed by the lip extending around the perimeter of the upper panel; a bottom edge formed by the lip extending around the perimeter of the lower panel, and an intermediate area between the edges, the intermediate area configured such that the edge of the bottom dock panel forms more of the intermediate portion of the slot than the edge of the top panel; and providing a coupling member; and sliding the coupling members into the channels on the first and second dock sections to hold the sections together.

* * * * *